US011312564B2

(12) United States Patent
Ryan

(10) Patent No.: US 11,312,564 B2
(45) Date of Patent: Apr. 26, 2022

(54) SUSTAINABLE RESERVOIR-BASED STORAGE, TRANSPORT, AND DELIVERY SYSTEM

(71) Applicant: Michael C. Ryan, Mitchellville, IA (US)

(72) Inventor: Michael C. Ryan, Mitchellville, IA (US)

( * ) Notice: Subject to any disclaimer, the term of this patent is extended or adjusted under 35 U.S.C. 154(b) by 0 days.

(21) Appl. No.: 16/120,049

(22) Filed: Aug. 31, 2018

(65) Prior Publication Data

US 2020/0071059 A1 Mar. 5, 2020

(51) Int. Cl.
*B65D 83/00* (2006.01)

(52) U.S. Cl.
CPC ..... *B65D 83/0033* (2013.01)

(58) Field of Classification Search
CPC .. B65D 83/0033; B65D 83/62; B65D 83/386; B65D 83/207
USPC ..... 222/389, 394, 396, 399, 401, 402
See application file for complete search history.

(56) References Cited

U.S. PATENT DOCUMENTS 2,504,683 A * 4/1950 Harnley ..... F16N 39/06 222/189.08
3,282,473 A * 11/1966 Moore ..... B05C 17/002 222/327
3,367,545 A * 2/1968 Cook ..... B65D 83/643 222/389
3,613,734 A * 10/1971 Elmer ..... F15B 1/24 138/31
4,197,884 A * 4/1980 Maran ..... B65D 83/42 141/113
4,355,736 A * 10/1982 Schumacker ..... B65D 83/64 222/386.5
4,632,279 A * 12/1986 Donaldson ..... H02G 1/14 174/88 R
4,664,298 A * 5/1987 Shew ..... F16N 3/12 184/105.2
4,714,094 A * 12/1987 Tovagliaro ..... F15B 1/24 138/31
4,877,156 A * 10/1989 Clanet ..... B65D 83/64 222/386.5
5,163,584 A * 11/1992 Huber ..... E04D 1/34 222/1
5,842,605 A * 12/1998 Lehmkuhl ..... B05B 11/3001 222/95
5,863,146 A * 1/1999 Denkins ..... B05B 7/2437 401/171
6,131,776 A * 10/2000 De Laforcade ..... B65D 83/64 222/387
7,108,016 B2 * 9/2006 Moskalik ..... B60K 6/12 138/26

(Continued)

FOREIGN PATENT DOCUMENTS

WO WO 95/04690 * 2/1995

*Primary Examiner* — Lien M Ngo
(74) *Attorney, Agent, or Firm* — Prudens Law LLC; Shawn Diedtrich

(57) ABSTRACT

A reservoir-based storage and delivery system has a reservoir body equipped with a top assembly, a bottom assembly and a piston assembly. The contents of the reservoir are allowed to expand and contract during the thermal cycle due to the ability of the piston assembly to float within the reservoir, which eliminates the need for dead head space.

17 Claims, 14 Drawing Sheets

(56) References Cited

U.S. PATENT DOCUMENTS

| | | | | |
|---|---|---|---|---|
| 7,475,797 | B2 * | 1/2009 | Kim | A61M 5/14526 222/387 |
| 8,695,643 | B2 * | 4/2014 | Rajabi | F15B 1/24 138/109 |
| 9,297,498 | B1 * | 3/2016 | Kuntzelman | F16N 3/12 |
| 9,751,689 | B2 * | 9/2017 | DiNovo | B65D 90/22 |
| 9,874,310 | B2 * | 1/2018 | Sorg | B05C 17/00576 |
| 10,246,248 | B2 * | 4/2019 | Vanderstraeten | B65D 83/38 |
| 2008/0029549 | A1 * | 2/2008 | Hulden | F16N 3/12 222/256 |
| 2008/0087686 | A1 * | 4/2008 | Markovsky | B41F 31/02 222/389 |
| 2008/0105706 | A1 * | 5/2008 | Tsai | B05B 11/0045 222/95 |
| 2015/0166252 | A1 * | 6/2015 | Jones | B65D 83/62 222/389 |

* cited by examiner

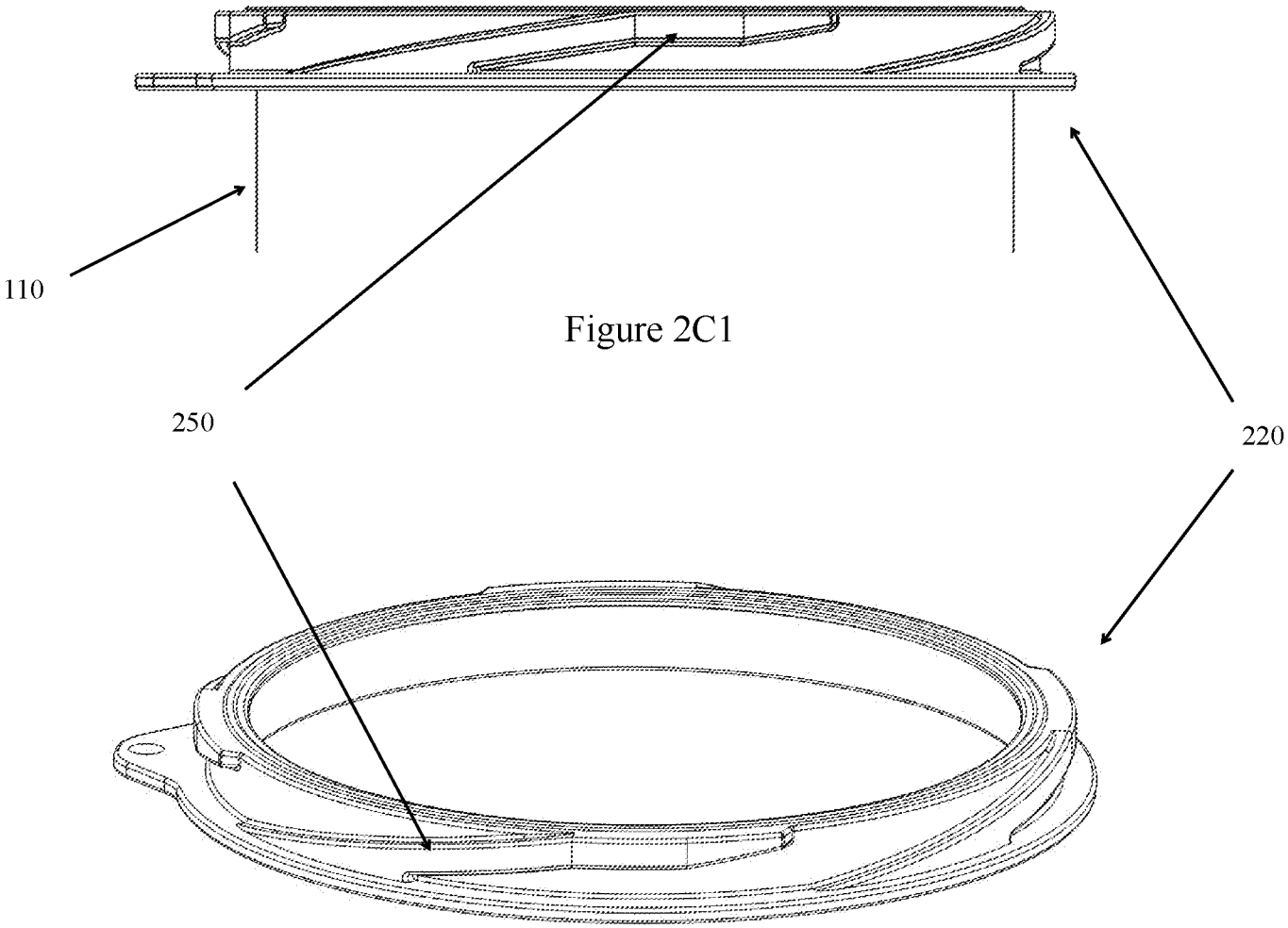
Figure 2C1
Figure 2C2

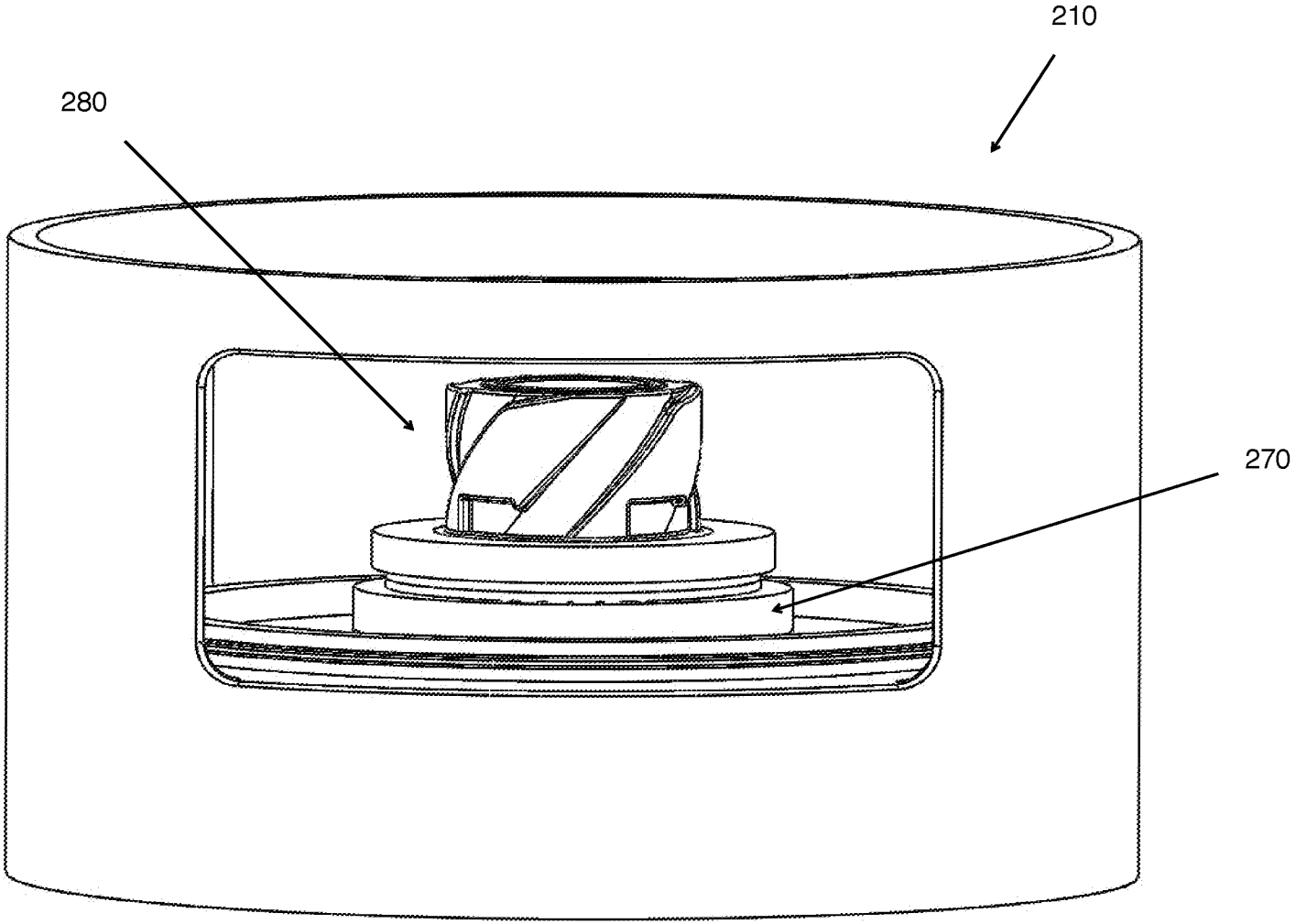
Figure 2E1

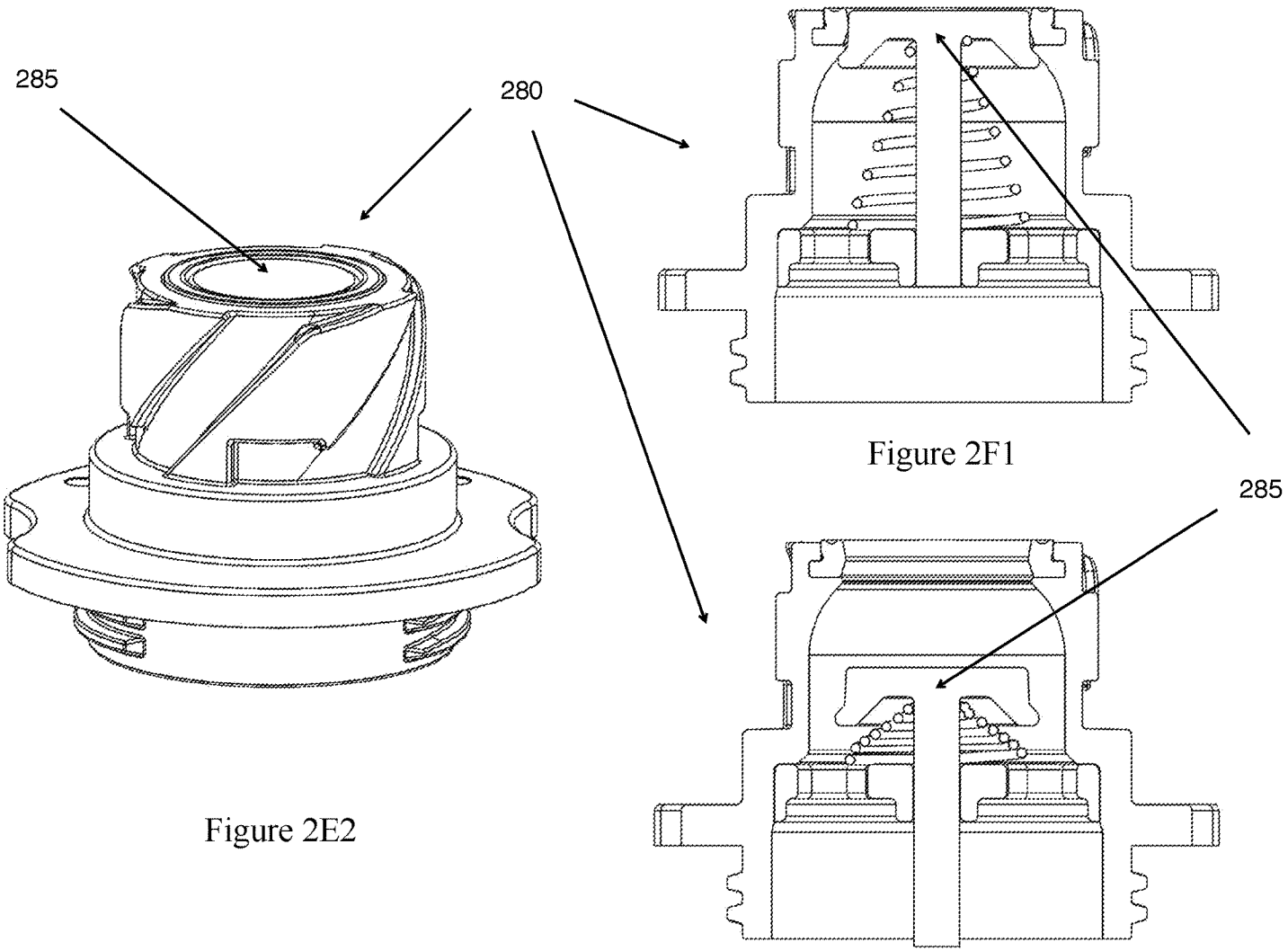
Figure 2F1
Figure 2F2
Figure 2E2

Figure 4C1
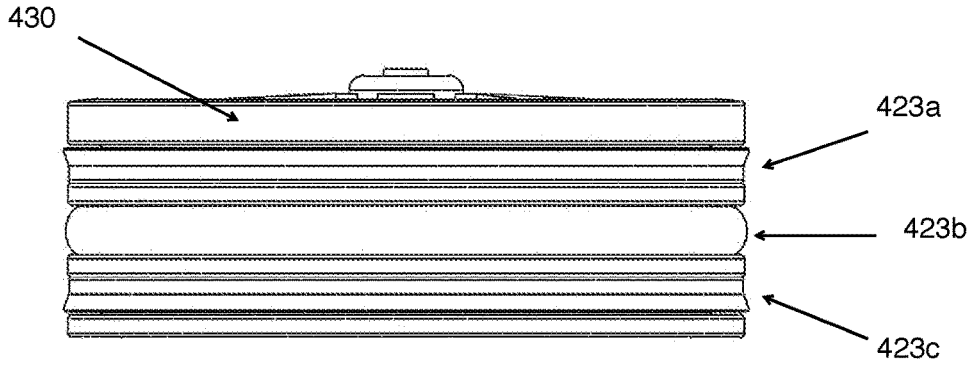
Figure 4C2
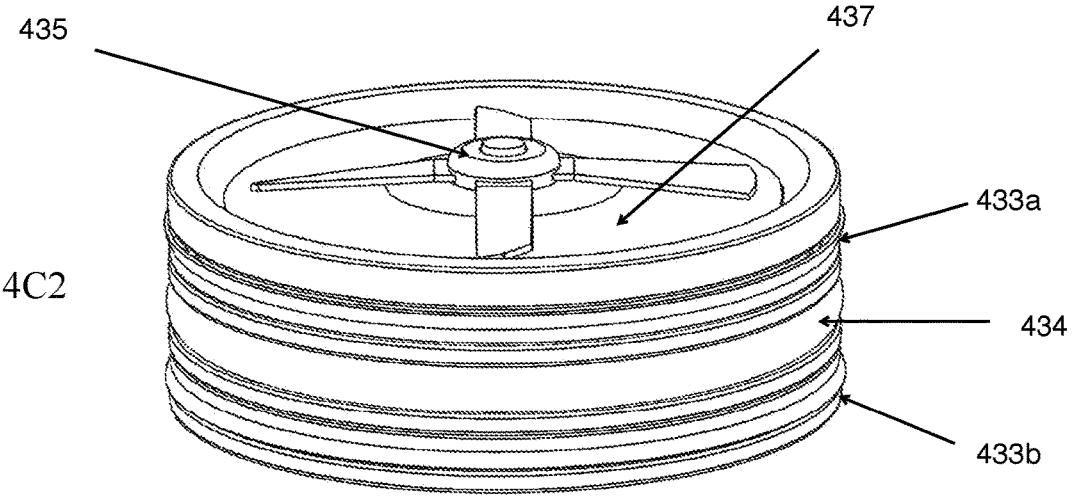
Figure 4C3
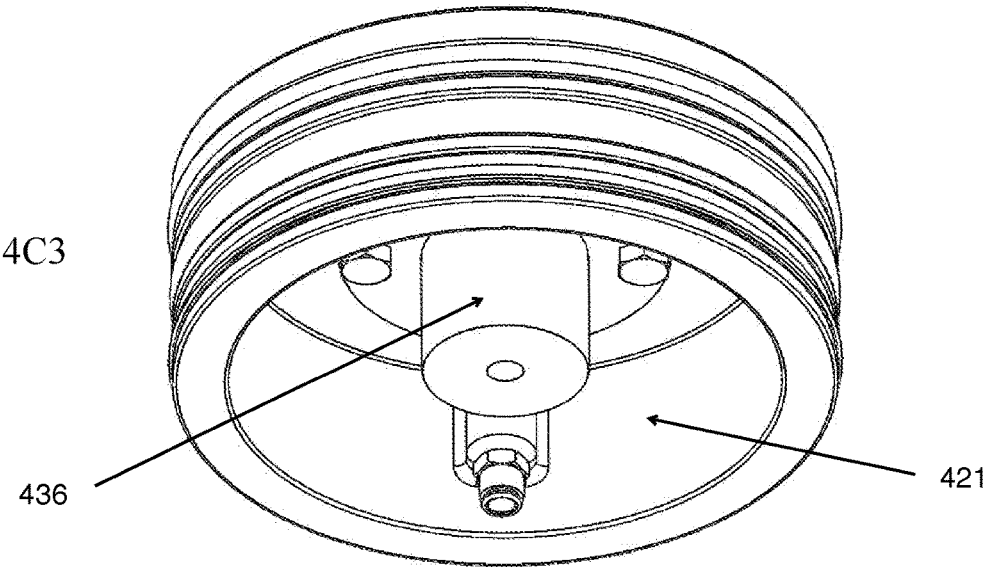

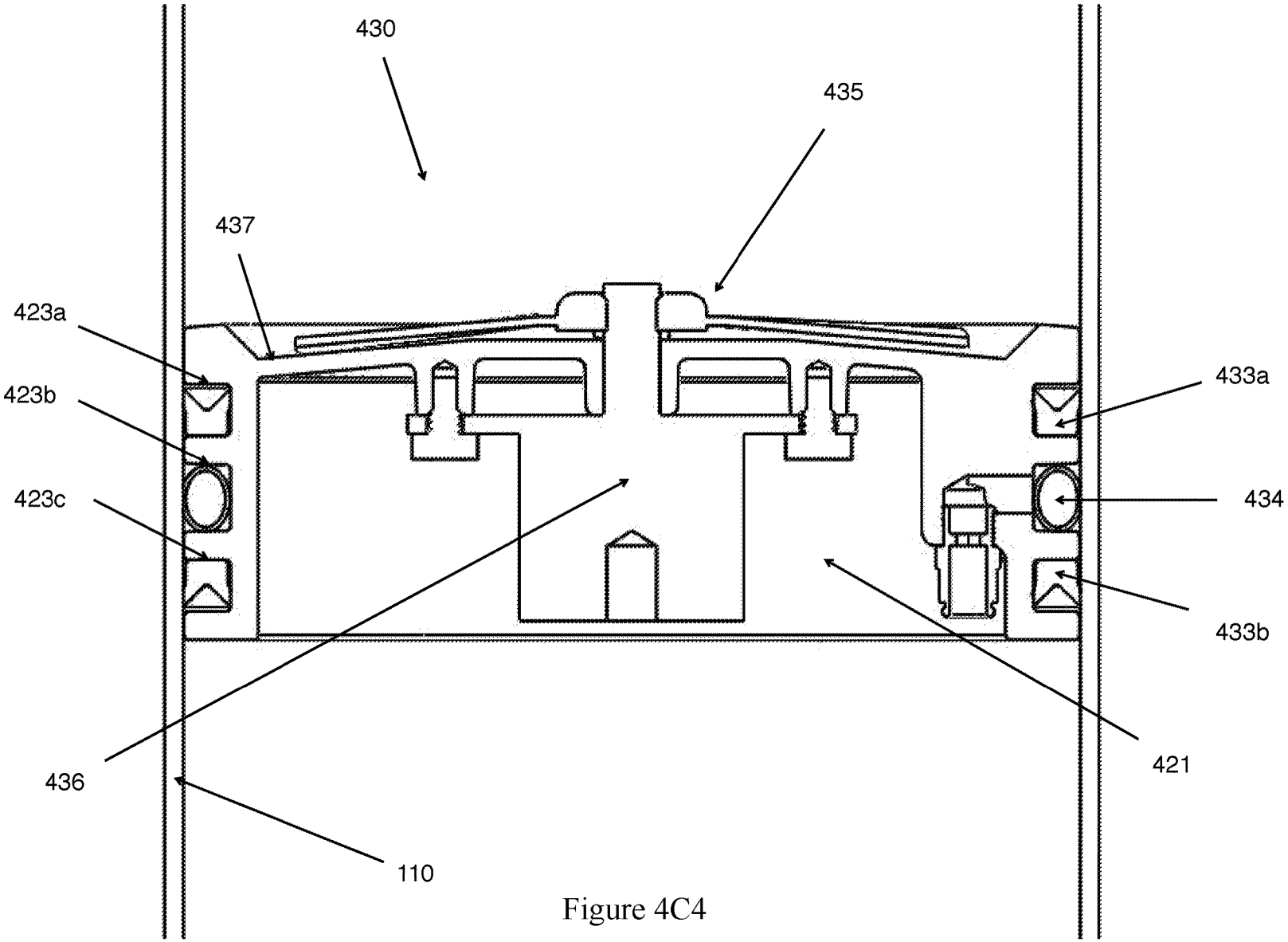
Figure 4C4

SUSTAINABLE RESERVOIR-BASED STORAGE, TRANSPORT, AND DELIVERY SYSTEM

TECHNICAL FIELD

The invention is generally related to the storage and distribution of material. More particularly, the invention pertains to systems and methods for the efficient use and management of the product life cycle during the storage, distribution, handling, recapture, and recycling of material used in various industries.

BACKGROUND

The storage, distribution, and use of fluids or fluid-like material is everywhere in the modern economy. Various containers and systems have been devised to manage the life cycle of fluid use. For example, in the lubrication industry, bulk storage of lubrication material (e.g., grease or oil) is stored in large metal drums that are filled and then sealed. Those drums are then transported to another site so that the material may be transferred into smaller containers for distribution, use, or sale to other sites that may yet again transfer the material to even smaller containers. These smaller containers are then used in specific applications, e.g., a grease gun, painting equipment, or beverage dispensing.

Within this overall distribution and transfer system, a number of issues are introduced seemingly at each stage of transfer. In the case of large drums, fluid transfer to a smaller container frequently exposes or introduces contaminants, e.g., air, moisture, chemicals, dust, or other small particles to the transferred material. These contaminants may not only affect the material but can affect the operating equipment that transfers or eventually uses the material. Also, the construction of these legacy containers enables the outgassing of vapors from stored material (e.g., when the stored material experiences a rise in temperature) and the drawing of moisture and external air into the container and the stored material (e.g., when the container is cooled). Contamination and outgassing are just two issues. The more complex the distribution channel, the higher the percentage for the introduction of contamination, outgassing, or other issues.

Another issue in the industry is that the full volume of a storage container cannot be utilized. When storing liquids in a sealed container, a certain amount of space ("dead head space") must be left in the container to allow for expansion and contraction of the liquid (e.g., due to temperature changes). Volatile fluids produce gasses from within the liquid ("outgassing"), which creates a cycle of the expulsion of gasses from the container and drawing of atmospheric air, moisture, and contaminants into the container. Essentially this wasted dead head space results in various inefficiencies within the supply chain. For example, containers that are larger than needed to store and transport a defined volume of product. The larger container results in increased manufacturing costs. The increased container weight results in increased shipping costs—more fuel because the containers weigh more, and larger trucks/ships, etc. because more space than the volume of the liquid is needed to store the liquid. Likewise, warehouse costs are larger because more space is required. At each stage, costs are increased simply because the storage container must be larger than the volume of the liquid to accommodate dead head space.

Another issue is that containers and receiving reservoirs for material are not standardized within the distribution chain and in equipment reservoir design. This lack of standardization leads to the need for a variety of methods for the transfer of fluids between different sized containers. For example, a large metal drum full of fluid (like lubricating oil, grease, molasses, olive oil, paint, epoxy, or urethane) may be delivered to a factory for use. To transfer a portion of the fluid to its final application, the drum may need to be placed on its side, hoisted into the air, or have other holes drilled into it so that the fluid may be poured or otherwise transferred into a smaller container. In some instances, a tube attached to mechanical or electrical pump is inserted into the storage container that extends to the bottom of the container to transfer the fluid. Such a design results in fluid being left at the bottom of the container. Not only can the fluid become contaminated during each transfer operation but the introduction of atmospheric air and moisture into the transferring container is sometimes necessary to replace the volume of exiting fluid. This allows contaminated fluid to flow from the container, which consequently contaminates the remaining stored fluid in the container.

Furthermore, fluid containers are frequently designed for one-time usage. For example, a caulk/mastic container is purchased, used once, and then thrown away, frequently with some residual fluid remaining within the container. In some cases, clean-up and removal of the residual material can be difficult, costly, and dangerous. Rather than clean and remove the fluid from the one-time use containers, it is more economical to simply discard the container. As such, the usage, clean-up, and disposal of some of these materials is highly regulated.

An important consideration in many storage container applications is temperature fluctuations within the container. Thermal fluctuations cause movement of gas between the outside atmosphere and the gas-filled dead head space of the container. For partially filled containers, with greater head space, this air movement is increased. Although a drum or container may be sealed and not leaking fluid, a rigid container still inhales atmospheric gas when the temperature drops and exhales as the temperature rises. Combined with the air in the atmosphere, moisture and small airborne particles enter the fluid container possibly leading to degradation of the base stock and additives. Also, entry of atmospheric moisture into the container may cause condensation within the container, further contaminating the liquid.

What is needed is a system of reusable, sealed reservoirs that enable the control and efficient use and management of the product life cycle during the storage, distribution, handling, recapture, and recycling of material.

SUMMARY

While the way in which the invention addresses the disadvantages of the prior art will be discussed in greater detail below, in general, the invention provides for a system of sealable reservoirs that enable efficient storage, distribution, use, and recapture of material from its initial production to the end of the material's life cycle.

A reservoir-based storage and delivery system may include a reservoir body equipped with a top assembly and a bottom assembly. As will be described in detail below, the top assembly may be configured to operatively connect to, and seal, one end of the body, while the bottom assembly may be configured to operatively connect to, and in some cases seal, the opposing end of the body. A piston assembly may be placed within the body so that it is able to move up and down the inside of the body. The piston assembly creates two areas, a material containment area and a pressurization area, within the body. These areas are sealed from each other by the piston assembly so that material cannot flow between the two areas. The piston assembly moves up and down inside the body based on the pressure differential between the material containment and pressurization areas. For certain operations, the body may be placed on a charge base. The charge base may be configured to operatively connect to the bottom adaptor ring so that a pressurization agent may be introduced into or withdrawn from the pressurization area.

Movement of the piston assembly may be accomplished in multiple ways. For example, a pressurization agent may be introduced into the pressurization area or a vacuum may be applied to the pressurization area, which would move the piston assembly up or down, respectively; (2) introducing or withdrawing material from the material containment area, which would move the piston assembly down or up, respectively; or (3) a vacuum may be applied to the material containment area through the top assembly. In general, a dispensing operation may include opening a pathway from the material containment area through the top assembly of the reservoir. The pressure differential between the top and bottom areas within the body of the reservoir forces the piston assembly to move upwards, therefore dispensing the material.

In embodiments with an assembled reservoir and operatively connected charge base, the charge base may introduce a vacuum to the pressurization area. The vacuum results in the piston assembly being drawn toward the bottom of the reservoir. Such configuration may be used to draw fluid into the storage reservoir through the top assembly, for example, from another container. One benefit of the vacuum process is transferring material between two reservoirs or a reservoir and another type of container so that the material is not exposed to atmospheric air and potential contamination. Another benefit is that used material may be reclaimed from end use equipment.

BRIEF DESCRIPTION OF THE DRAWINGS

FIG. 2C1 illustrates an exemplary quick thread adaptor ring attached to the top of a reservoir body.

FIG. 2C2 illustrates an isometric view of an exemplary quick thread adaptor ring.

FIG. 2E1 illustrates an exemplary adaptor coupling connected to a top cap adaptor fitting.

FIG. 2E2 illustrates an exemplary adaptor coupling.

FIG. 2F1 illustrates an exemplary moveable poppet used in an adaptor coupling in the closed position.

FIG. 2F2 illustrates an exemplary moveable poppet used in an adaptor coupling in an open position.

FIG. 4C1 illustrates a side view of an exemplary embodiment of a conditioning piston assembly in a cylindrical reservoir embodiment.

FIG. 4C2 illustrates a top view of an exemplary embodiment of a conditioning piston assembly in a cylindrical reservoir embodiment.

FIG. 4C3 illustrates a bottom view of an exemplary embodiment of a conditioning piston assembly in a cylindrical reservoir embodiment.

FIG. 4C4 illustrates an exemplary conditioning piston assembly placed within a cylindrical reservoir.

DETAILED DESCRIPTION

Various embodiments of the invention are described in detail below. While specific implementations involving storage and delivery reservoirs are described, it should be understood that their description is merely illustrative and not intended to limit the scope of the various aspects of the invention. A person skilled in the relevant art will recognize that other components and configurations may be easily used or substituted than those that are described without parting from the spirit and scope of the invention. As will be appreciated by one of ordinary skill in the art, the system may be embodied as a customization of an existing system, an add-on product, and/or a stand-alone system.

The invention, in its various embodiments, has the ability to store and distribute fluid or fluid-like material with no, or limited, exposure to outside elements. In its various embodiments, the invention enables material to be stored within the reservoir under constant pressure without the need for unwanted dead head space. The invention also enables the material to expand and contract during the thermal cycle of the stored material. In its various embodiments, the systems and methods of the present invention may be used for various materials. The types of material that may be used with the invention will be readily apparent after reading this specification. In this specification, the terms "material," "fluid," "fluid-like," or "liquid" shall be used interchangeably within the specification and is intended to encompass gasses, fluids, liquids, solids that may exhibit fluid-like properties (e.g., a powder), elastic solids and the like that are used with the invention.

Moreover, the systems and methods facilitate storing, transporting, mixing, conditioning, distributing, dispensing, and/or recycling material with no, or limited, exposure to outside elements. The systems and methods provide for a complete chain of custody of material transfer throughout the supply chain. As described below, the invention provides a reservoir having a reservoir body, a top assembly, a bottom assembly, and a piston assembly. Additionally, the invention provides a charge base that when operatively connected to the reservoir assembly provides introduction and regulation of a pressurization agent used to move the piston assembly.

Thus, as will become apparent from the following descriptions, the invention facilitates an efficient, secure, and environmentally sustainable way to store, package, transport, distribute, dispense and/or recycle almost any type of material.

Reservoir

Figures 1A, 1B:
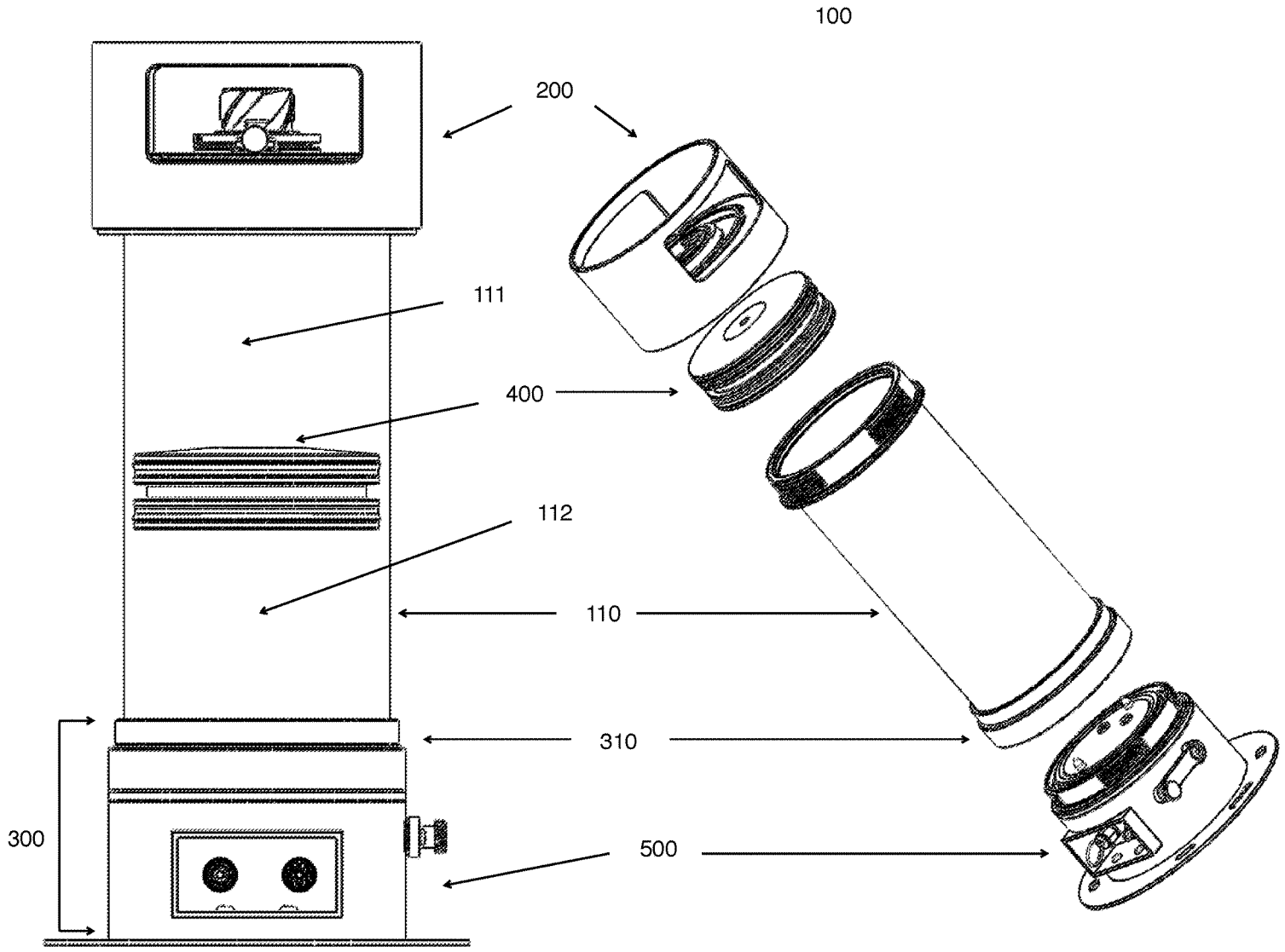
FIG. 1A illustrates a side view of an exemplary reservoir.
FIG. 1B illustrates an exploded view of an exemplary reservoir.

FIGS. 1A and 1B illustrate a generic reservoir 100 of the present invention. In general, a reservoir body (or "body") 110 may be equipped with a top assembly 200 and a bottom assembly 300. As will be described in detail below, the top assembly 200 may be configured to operatively connect to, and seal, one end of the body, while the bottom assembly 300 may be configured to operatively connect to, and in some cases seal, the opposing end of the body 110. A piston assembly 400 may be placed within the body 110 so that it moves up and down the inside of the body 110. The introduction of the piston assembly 400 into the body 110 creates two areas, a material containment area 111 and a pressurization area 112. These areas, 111 and 112, are sealed from each other by the piston assembly 400 so that material cannot flow between containment area 111 and pressurization area 112. The piston assembly 400 moves up and down inside the body 110 based on the pressure differential between the material containment 111 and pressurization 112 areas. For certain operations, the body 110 may be placed on a charge base 500. The charge base 500 may be configured to operatively connect to the bottom adaptor ring 310 so that a pressurization agent may be introduced into or withdrawn from the pressurization area 112.

The body 110 may be configured as a tube to contain the material to be distributed and may be designed according to its end use. For example, the cross section of the body may be circular, oval, square, hexagonal or some other suitable shape depending on the application. The body may be of any suitable material depending on the application. In some of the embodiments described below, the body may be composed of a glass filament wound epoxy/polyester-based resin, aluminum, acrylic, or polycarbonate. In some embodiments, the reservoir body may contain a UV-blocking material or other type of blocking material. The reservoir body may be configured in a variety of sizes (e.g., various diameters and lengths) according to its end use. In some embodiments, the body may be configured to contain 14 ounces of material. In other embodiments, for example bulk storage, the body may be configured to contain 140 ounces of material. For larger embodiments, the body may be configured to contain 55 gallons. However, any body configuration suitable for a particular application may be used.

The body 110 may be any color, including clear, depending on the application. The coloring may also be opaque, translucent, or transparent. In many embodiments, the choice of coloring may be used to indicate any number of characteristics of the reservoir. For example, the coloring may indicate the contents of the reservoir. Other examples include indicating the origin or destination of the contents. Yet other examples include indicating the manufacturer of the reservoir or the distributor of the contents. Any indication scheme related to coloring of the reservoir may be used.

Top Assembly

Figures 2A, 2B:
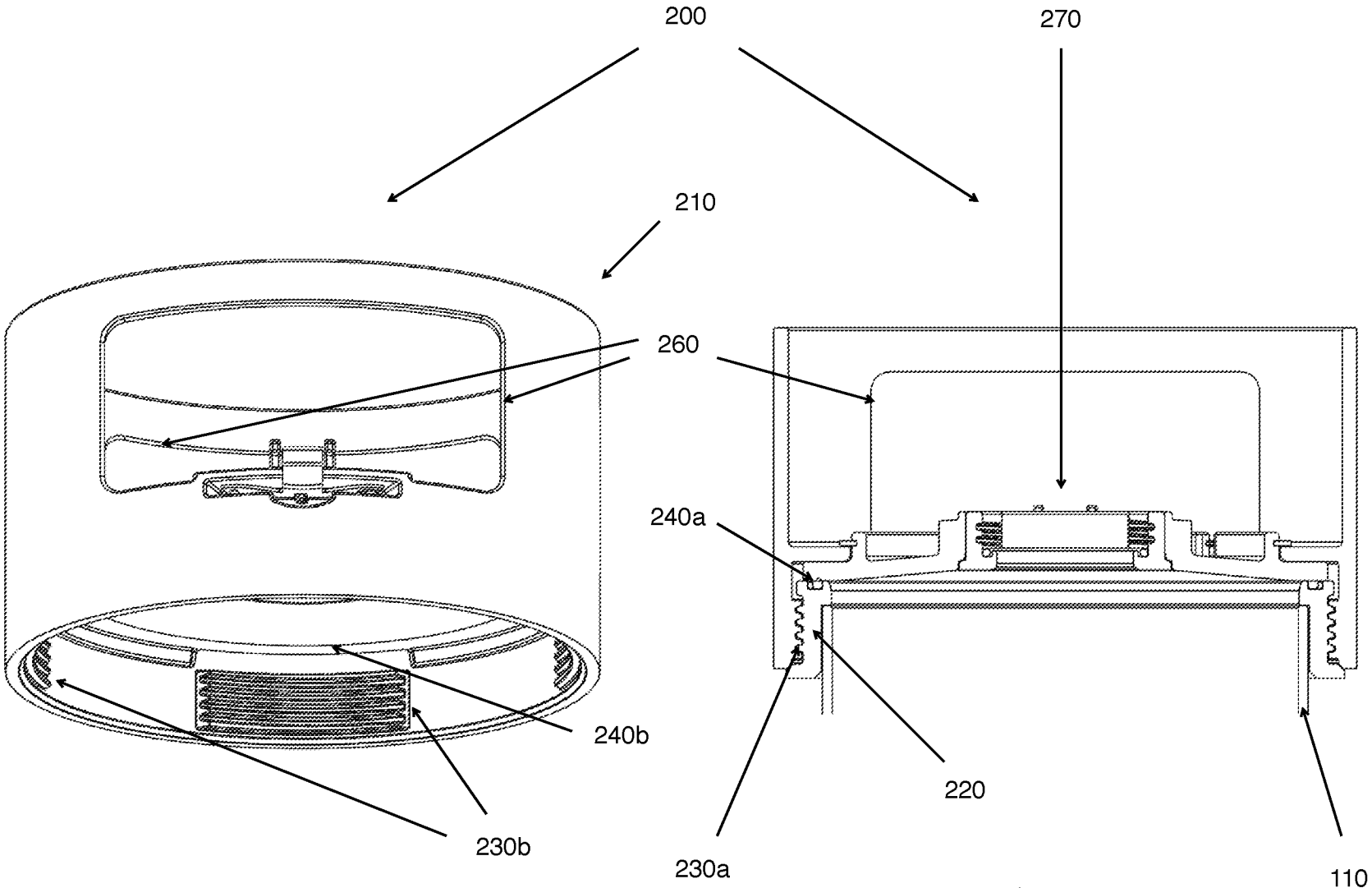
FIG. 2A illustrates an exemplary top assembly.
FIG. 2B illustrates the side view of an exemplary top cap sealed to the body utilizing an adaptor ring.

With reference to FIG. 1, the top assembly 200 may be configured to operatively connect to, and seal, one end of the reservoir body 110. FIG. 2A illustrates a generic top assembly 200 of the invention before attachment to the reservoir body 110. The top assembly 200 may include a top cap 210 which is secured to the reservoir body 110 with a top cap adaptor ring 220. The top cap adaptor ring 220 may be configured to provide a connection point for the top cap 210 to securely attach to, and seal, the top cap to the reservoir body 110. The top cap adaptor ring 220 connection type will depend on a variety of factors, such as reservoir body composition, operating pressure requirements, and intended delivery type. In some embodiments, the top cap adaptor ring 220 connection may be accomplished through locking threads 230*a* and 230*b* on the adaptor ring 220 and the top cap 210. The top cap 210 is placed on the adaptor ring 220 so that the locking threads 230*a* on the top cap 210 fit into the spaces between the locking threads 230*b* on the adaptor ring 220. The top cap 210 is then twisted in the appropriate direction to lock the top cap 210 in place (as shown in FIG. 2B). The top cap adaptor ring 220 may include a surface 240*a* that seals against top cap 210 sealing surface 240*b*.

In other embodiments, the top cap adaptor ring 220 connection (shown in FIGS. 2C1 and 2C2) to the reservoir body 110 may be configured as a quick thread 250. The complementary top cap quick threads are placed into the appropriate openings of the adaptor ring 220 quick threads. As the top cap is twisted, the slant of the quick threads 250 forces the top cap and the adaptor ring 220 together until they are sealed and locked into place.

Although the adaptor ring 220 has been shown as being adhered to the outside of the reservoir body 110 (a "male" connection), the adaptor ring 220 may be configured to be on the inside of the reservoir body 110 (providing a "female" connection) for some embodiments. In these embodiments, the top cap threads would then be configured on the outside of the top cap 210 (not shown). In other embodiments, the adaptor ring may be a push-to-connect connection.

In its embodiments, the connection type and seal type may depend on multiple factors such as reservoir body composition, operating pressure requirements, and intended delivery type. Different embodiments may include cam locks, ball locks, bail and seal, pin locks, or push-to-connect connection. However, any connection now known or known in the future that accomplishes a sealed connection of the top cap to the reservoir body may be used.

In its various embodiments, the adaptor ring 220 may be secured to the reservoir body in a variety of ways depending on the composition of the reservoir body and the adaptor ring. The connection and seal should be able to withstand the operating pressures of the reservoir while providing the needed structural integrity of the intended use. For example, in large reservoirs, operating pressures may reach and exceed 100 psi of operating pressure. In some embodiments, the adaptor ring 220 may be aluminum and the reservoir body may be composed of a glass filament wound resin. The adaptor ring 220 may be secured to the reservoir body 110 via an adhesive system. In some embodiments, the adhesive system employs two-part methacrylate adhesives. An example of such a system is MP 55305 from Adhesive Systems, Inc. However, any adhesive system now known or known in the future that facilitates a secure connection of the top cap to the reservoir body is may be used. In some embodiments, the adaptor rings may be press fit.

Though described above as a two-piece system (a top cap 210 and an adaptor ring 220 that is then secured to the body 110), in other embodiments, the adaptor ring may be molded, or otherwise incorporated, into the reservoir body 110, essentially forming one piece. In such a case, the top cap is connected to the reservoir body through a particular connection type. For example, locking threads may be molded into the reservoir body and the top cap is placed on the reservoir body and screwed until a seal is made. Also, the use of the term "ring" is not intended to limit the adaptor ring to the shape of a circle. As described above the term "adaptor ring" as used in this description is intended to describe an element that possesses the functionality as described above. The shape of the "rings" will be determined by other design factors including the cross-sectional shape of the reservoir body. For example, a square reservoir body may incorporate a square adapter ring that possesses the same functionality of a circular adaptor ring. In some embodiments, the adaptor ring may also be a multi-piece construction.

Furthermore, a variety of methods may be used to provide a seal or enhance the sealing properties of the connection. In many embodiments, flat faced seals, O-rings, quad seals, house seals, u-cup seals, or spring backed seals may be used. For example, in FIG. 2A, the sealing surface 240*a* may include an O-ring placed on or within the surface 240*a* such that when the top cap 210 is secured, the O-ring enhances the seal made between the adaptor ring 220 and the top cap 210. In other embodiments, the seal is a flat faced metal to metal surface sealing.

In its various embodiments, the top cap 210 may include one or more areas for handling the assembled reservoir. Such handling areas may be suitable for handling by a person or machine. As shown in FIGS. 2A and 2B, the top cap 210 includes one or more handling areas 260 that have been milled, molded, or otherwise configured into the top cap 210. A person would place their hands on the top of the handling area to manipulate the top cap or assembled reservoir. Any number of handling areas suitable for the intended application may used. It is contemplated that the reservoirs may be manipulated through mechanical means such as through robotic-assisted or robotic automation. In addition to the already described handling areas, other embodiments may configure handling areas such that another component also provides handling areas. For example, top cap construction may continue down the sides of the reservoir so that a mechanical arm or hand may pick up the reservoir for it to be moved. In some embodiments, the handling area may be molded or cast into the reservoir body.

Figure 2D:
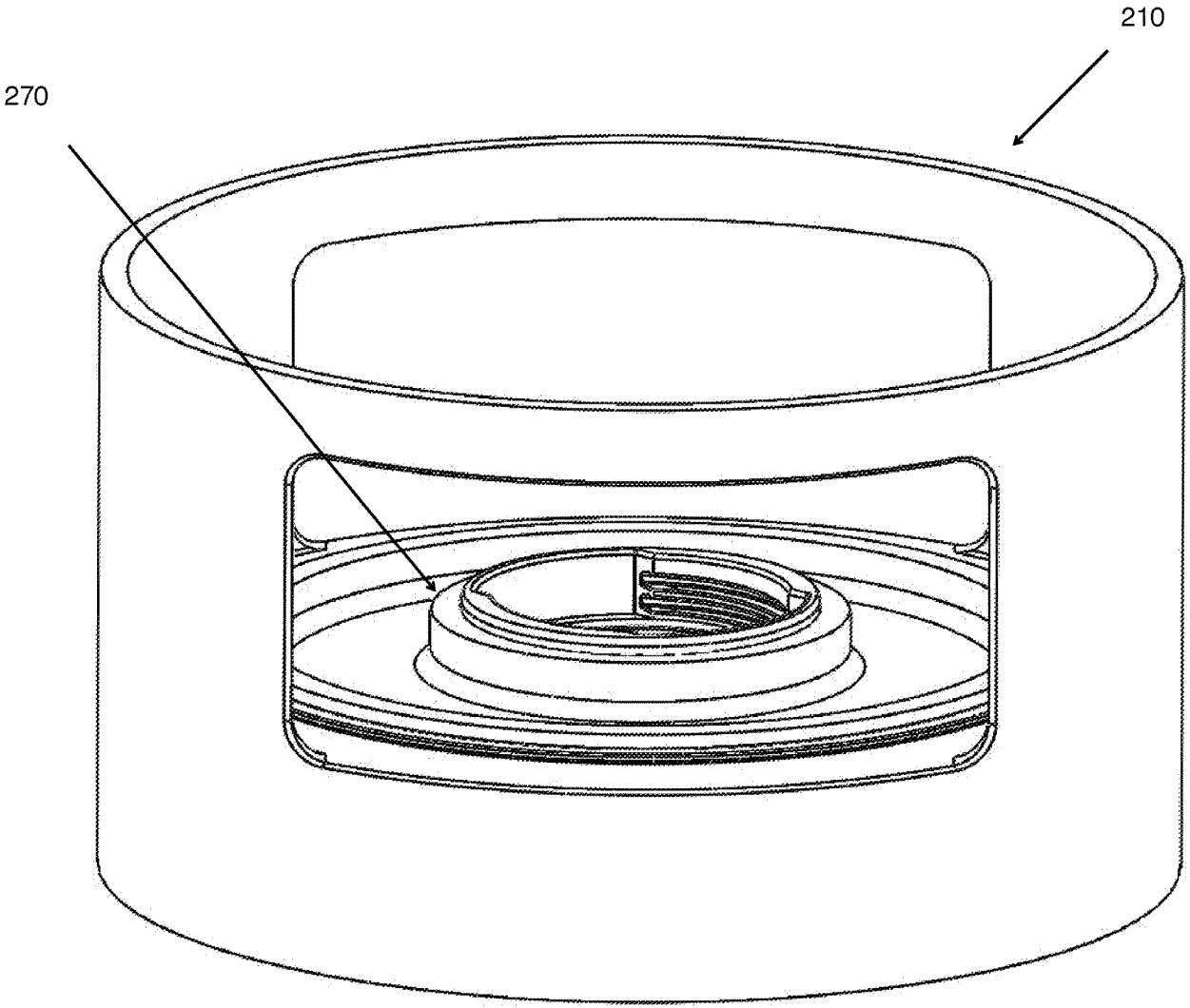
FIG. 2D illustrates an exemplary top cap adaptor fitting.

The top cap 210 may be also configured with an adaptor fitting 270 (FIG. 2B, and FIG. 2D). The adaptor fitting 270 enables the reservoir to be adapted to an unlimited number of connection types for an adaptor coupling 280 (shown in FIG. 2E1 and FIG. 2E2) The adaptor coupling 280 enables one to adapt reservoirs to an unlimited number of intermediate or end uses.

Though the adaptor fitting 270 is shown as a circular fitting, any suitable shape and size may be used. The adaptor fitting 270 may be integrated into the top cap 210 as one piece (as shown in FIG. 2D) or it may be composed of one or more components that are then secured to the top cap 210 through a variety of methods. For example, one method may be welding a multi-piece fitting around a hole provided in the top cap. Another example the adaptor fitting being molded as part of the top cap. In some embodiments, the adaptor fitting 270 may include threading on its outside edge (a "male" fitting) so that an adaptor coupling 280 may be secured to the top cap 210 and provide a suitable seal that withstands internal pressure and prevents contamination of material inside the reservoir body. In other embodiments, the threading may be configured on the inside edge of the adaptor fitting 280 (a "female" fitting) so that a male adaptor coupling may be used. In other embodiments, a press fit connection type may be used.

FIG. 2E2 illustrates a generic adaptor coupling of the invention. In addition to sealing the reservoir body, the adaptor coupling 280 provides a connection to its end use or another reservoir. In its embodiments, when connected to an adaptor of an apparatus configured for the reservoir's end use or another reservoir, the adaptor coupling 280 may be activated to enable material flow out of the reservoir. In some embodiments, the adaptor coupling 280 (also shown in FIG. 2F1 and FIG. 2F2) may include a moveable poppet 285, which is configured to be displaced (FIG. 2F2) upon connection to a complementary coupling such that an opening in the end of the adaptor coupling 286 from the reservoir body through the adaptor coupling 280 is created. The moveable poppet 285 returns to its sealed position (FIG. 2F1) when the connection from the end use or another reservoir is disengaged. Similar to the adaptor fitting and the adaptor ring, the adaptor coupling 280 may be configured to be a male or female connection depending on the particular use.

In some embodiments, the adaptor coupling may include a dry break fitting to ensure a transfer of material within a sealed environment. When used with application equipment also equipped with a complementary dry break fitting, the dry break fitting enables the reservoir to stay pressurized and prevent contamination of material or spillage. Thus, material is unable to escape or become contaminated during a transfer, which provides for an environmentally sustainable transfer process. In some embodiments, the adaptor coupling may include a seal cap that provide further sealing functionality (e.g., prevents in or out gassing) and/or protection from contamination (e.g., keeps the face of the adaptor coupling(s) clean). In some embodiments, the seal cap may also serve as an indicator, e.g., color-coding. Any dry break fitting (also known as dry break couplings, dry disconnect couplings, or dry break) now known or known in the future may be used.

The top assembly may also employ one or more locking mechanisms configured to lock the top cap, adaptor fitting, and/or adaptor coupling and prevent unwanted removal and/or movement. The locking mechanism may be configured to indicate to the user that the correct position of the top assembly (or its various components) is assembled into the proper location and is ready for further operation (e.g., pressurization, movement, use). The locking mechanism may also provide tamper proof or other security functionality. For example, as the top cap is moved into place one piece of the locking mechanism on the top cap engages with another piece of the locking mechanism on the reservoir or adaptor ring that prevents unwanted movement of the top cap once engaged. The top cap, adaptor fitting, and adaptor coupling may have separate locking mechanisms, such that they may be moved and secured independent of each other, or alternatively, one locking mechanism may secure the top cap, adaptor fitting, or adaptor coupling together. Also, the use of a locking mechanism for one component (e.g., the top cap) does not require the use of a locking mechanism for another other component (e.g., the adaptor). The locking mechanism may also include a status indicator that indicates whether the component is locked, open, or some other status. In some embodiments, the status indicator may be a visual indicator. For example, upon closing a colored indicator may appear as the component is closed/opened (e.g., green for secured or red for open). The indicator may be mechanical or digitally-based. Any indicator suitably configured for the desired application, including status flags, light indicators, or pins. Moreover, the locking mechanism may include an audible status indicator, which may be analog or digital. The locking mechanism may also be configured to transmit its status via Bluetooth, WiFi, or other similar wireless or wired electronic communication methods.

Piston Assembly

Figure 4A:
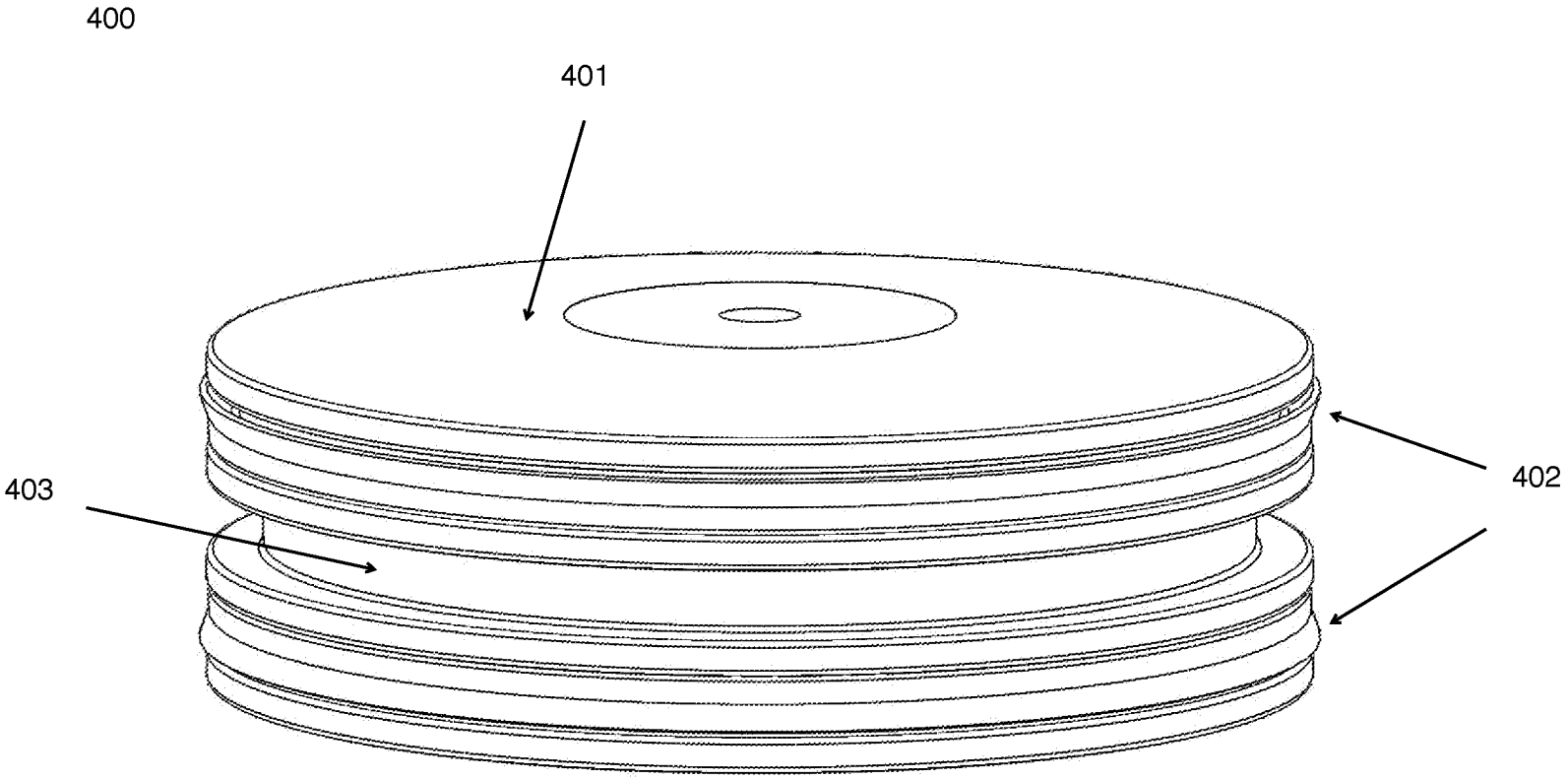
FIG. 4A illustrates an exemplary piston assembly.
Figure 4B:
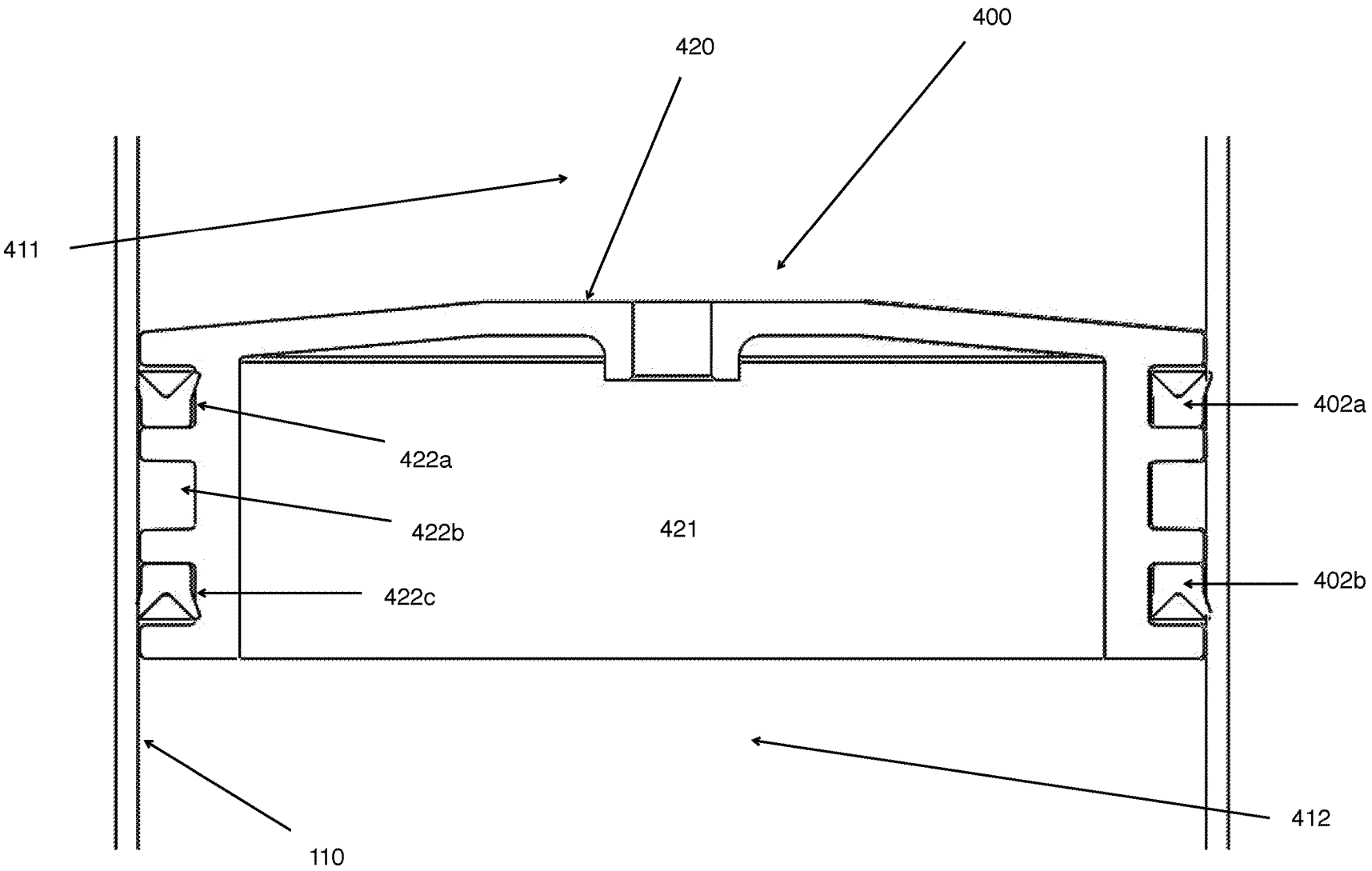
FIG. 4B illustrates an exemplary embodiment of a piston within the piston assembly in a cylindrical reservoir embodiment.

With reference to an exemplary embodiment in FIG. 1A, the piston assembly 400 may be placed within the body 110 so that the piston moves freely up and down inside of the body 110. FIG. 4A illustrates a generic piston 400 assembly of the invention. FIG. 4B illustrates a piston placed within the reservoir body. In general, a piston assembly 400 may be equipped with a piston 401 and a sealing agent 402. FIG. 4A illustrates a piston 401 that has three grooves circumventing the piston 401. In this example, the top and bottom grooves are occupied with sealing agents 402 (described further below). The middle groove may be used for additional functionality, for example, those embodiments that would utilize a torque suppression agent 403 (described below). In this particular example, a torque suppression agent is not used, thus the groove remains empty. In its embodiments, any number of grooves may be used to accomplish the goals of a particular end use (e.g., guide rings may be added to the piston assembly).

Piston 401 may be made from different materials depending on the particular application and type of material used in the reservoir. In some embodiments, the piston may be aluminum. In other embodiments, the piston may be polymer-based. In other embodiments, the piston may be composed of glass filled composite resin. The piston may be configured as one or more pieces, which may be molded or machined depending on the application. When assembled within the piston assembly, the piston "floats" within the reservoir body. In exemplary embodiments, the piston may be operatively connected within the reservoir body through the piston assembly (as described below).

A piston's cross section will generally take the shape of the cross section of the reservoir. However, other cross-sectional shapes may be employed. For example, a reservoir may have a square cross section having a piston assembly with a square cross section but with a piston having a circular cross section. Other designs may include a circular piston assembly having a square piston. Any shapes may be used for particular applications.

The top of the piston may be flat, concave, or convex depending on its end use. In an exemplary embodiment, the piston's top may have a convex sloped top. The bottom of the piston may be flat, concave, convex, or "hollowed out" depending on the application. In some embodiments, the hollowed-out bottom enables the reservoir to incorporate additional functionality. In other embodiments, the piston may be solid, and its top and/or bottom may be appropriately designed flat, concave, or convex depending on its desired end use.

The length of the sidewall of the piston 401 employed within the reservoir will vary based upon its desired end use. In general, a piston inside a container is subject to side loading forces that, if not compensated for, could cause the piston to become misaligned within the container. Improper alignment can enable material or pressurization to escape their respective areas within a container or can cause damage to the piston, piston seals, or the reservoir. In traditional applications of pistons (e.g., hydraulic or pneumatic), a supporting piston rod is used to guide and minimize or prevent these side loading forces. Piston 401 is a "floating" piston that does not utilize a piston rod for support. The length of the piston's sidewall provides the necessary structural integrity and surface contact with the reservoir sidewall to offset some of the side loading force as it travels the interior of the reservoir. A piston sidewall too short for a desired end use may cause unwanted side loading forces to be applied to the piston, piston seals, and the reservoir sidewalls, which would lead to failure. The type of stored material and its characteristics (e.g., viscosity, density, compressibility, etc.), composition of the reservoir body, use of sealing agents, or piston weight, composition, and design (e.g., aluminum composition, sloped top) are determinants of the length of the sidewall of a particular piston for a desired end use. To assist in further offsetting side loading forces, a piston may incorporate one or more guide rings. Guide rings used in pistons are well known and will not be described in detail here.

In some embodiments, the piston may be configured with a bleed valve to enable any air trapped on surface of piston, which may be a concern during filling operations. The bleed valve may be equipped to enable the trapped air to escape the material containment area into the pressurization area or otherwise outside of the reservoir. Depending on the application, a separate vessel may be configured to collect the trapped air. This vessel may be configured to be inside the pressurization area or outside the reservoir.

In some embodiments, the piston assembly may incorporate additional functionality operatively connected to the assembly. A non-exhaustive list of such functionality may include product mixing elements, heating or cooling elements, sensors, control elements, electrical connections, power supplies (e.g., batteries), check valves, bleed valves, pressure regulation components, high pressure storage vessels (e.g., small $CO_2$ cylinders) or communication elements (e.g., wireless, RF).

FIG. 1A illustrates a full view of placement of the piston assembly 400 within the reservoir body 110. FIG. 4B illustrates a close-up view of such placement. Placement of the piston assembly 400 creates two areas, a material containment area 411 and a pressurization area 412. The piston assembly 400 is operatively connected to and contained within the body 110, so that material cannot flow between area 411 and area 412. In its embodiments, the piston assembly 400 will generally be the cross-sectional shape of the reservoir, e.g., a cylindrical reservoir may have a disk-shaped piston assembly. Not only does the piston assembly provide a seal between the two areas, it also functions as a wiper against the walls of the reservoir. For example, as the piston assembly moves towards the top assembly, material is forced out of the material containment area. The piston assembly, through its components described herein, acts to wipe any "leftover" material from the interior reservoir walls. Thus, little to no residue is left behind on the reservoir sidewalls upon full dispensing.

A sealing agent 402 may be incorporated into the piston assembly to prevent material and/or pressurization flow during operation or storage. In its embodiments, the sealing agent may be a chemical and/or a physical-based agent. For example, in some embodiments, the piston assembly's exterior may be treated with a chemical compound to form a seal with the reservoir body 110 (e.g., a formed in place gasket) within the piston assembly 400, which would impede unwanted flow (i.e., leakage) between areas 411 and 412. In other embodiments, the sealing agent may be a physical agent, for example, a gasket. In yet other embodiments, the sealing agent may also function, or substantially function, as the piston (i.e., the sealing agent and piston are one in the same). For example, a piston made of gasket-like material may perform both functions within a reservoir. Other examples of sealing agents that may be used are O-rings, U-Cups, or quad rings. In other embodiments, the sealing agent may be comprised of both a physical and chemical agent. For example, a piston made of gasket-like material may be treated with a chemical sealing agent. In its embodiments, the sealing agent may be configured as a single component or a multi-part component. For example, FIG. 4B illustrates a two-component sealing agent (i.e., two U-cup seals 402*a* and 402*b*). However, any sealing agent now known or known in the future that accomplishes a seal between the pressurization and material areas may be used.

During operation, a pressure differential will be created between areas 411 and 412 that forces movement of the piston assembly within the body 110. This pressure differential for various types of operations may be created through various embodiments described below. The amount of pressure needed to move the piston assembly may vary based on the material to be dispensed, crack pressure of the sealing agent type, composition, geometric design, sealing tolerances, and coefficients of friction of the reservoir and sealing agents. Because of the interplay of these variables, different sealing agents will require different operating pressures, that is, the pressure needed to break or "crack" the sealing agent from the interior wall that formed the seal so that the piston will begin to move (up or down depending on the operation).

As described above, during operation, the piston assembly 400 may be subjected to side loading forces. Without accounting for these forces, the piston assembly may become misaligned within the reservoir rendering it inoperative or causing damage to the piston assembly or the reservoir. In addition to the length of the piston's sidewall being used to combat these side loading forces, the piston assembly 400 may incorporate a torque suppression agent (shown in FIG. 4C1 and described below) operatively connected to the piston assembly 400. In FIG. 4C1, the rotating impeller 435, when activated, produces rotational torque forces. An inflatable diaphragm 434 may assist in suppressing these forces during operation.

Other piston assembly embodiments optionally include an expansion agent. The expansion agent may be placed within the reservoir in the pressurization area. In essence, the expansion agent provides additional support to the piston assembly in operations, such as mixing or material conditioning operations, that create additional internal forces that may not be present during some operations, i.e., use of the expansion agent limits undesired movement of the piston assembly during certain operations, for example, mixing, conditioning, filling, or shipping operations. Moreover, the expansion agent also may be used to prevent or minimize vertical movement of the piston assembly. In some embodiments, the expansion agent may also lock the piston assembly, and/or torque suppression agent in place during the filling or material conditioning operations. In its embodiments, the expansion agent may be a chemical and/or a physical-based agent and may be configured as a single or multi-part component. In its embodiments, the expansion agent may take a variety of forms depending on the desired application and reservoir design. Design features of the expansion agent will vary based on the known internal operating pressure of a particular use and/or torque load requirements of the reservoir, the material to be dispensed, sealing agent type, composition, geometric design, sealing tolerances, and coefficients of friction of the reservoir, material, and sealing agents. In some embodiments, a compression "donut" may be placed below the piston assembly and be supported by a protruding flange member operatively connected to the reservoir body. In some embodiments, the expansion agent may be an O-ring. In other embodiments, the expansion agent may be a disk.

Depending on the end use and varying factors (e.g., cost), in some embodiments, the torque suppression agent and the expansion agent are combined into one component. In other embodiments, the torque suppression agent and the expansion agent may be two separate components that are connected together or linked to provide both functionalities. In other embodiments, the agents (one or both) may be connected to the piston or piston assembly. In other embodiments, neither of the agents are connected to the piston or piston assembly.

With further reference to FIG. 4B, the piston assembly 400 may be placed in a cylindrical reservoir embodiment. In this exemplary embodiment, the piston 420 may be a cylindrical disk that is concave or hollowed out at the bottom 421. The outside of the disk has three grooves, 422*a*, 422*b*, and 422*c*, cut into the circumference of the disk. Sealing agents 402*a* and 402*b* are disposed within grooves 422*a* and 422*c* and around the circumference of the disk. In this exemplary embodiment, the sealing agents 402 and 402 are u-cup seals composed of a rubber compound. U-cup seal 402*a* is situated in groove 422*a* so that the protruding "U" lip is pointed towards the top assembly of the reservoir. U-cup seal 402*b* is situated in groove 422*c* so that the protruding "U" lip is pointed towards the bottom of the reservoir. The piston 420 may be made of aluminum, however, the piston may be made of any material suitable for its particular application.

As described above, in some embodiments, piston 420 may incorporate a convex sloped top. The sloped top enhances the force of the stored fluid toward the top coupling of the reservoir. In those embodiments, the interior surface of the top cap may have opposite but corresponding slopes. Such sloping enhances the laminar fluid flow towards the top coupling during dispensing operations.

Figure 3:
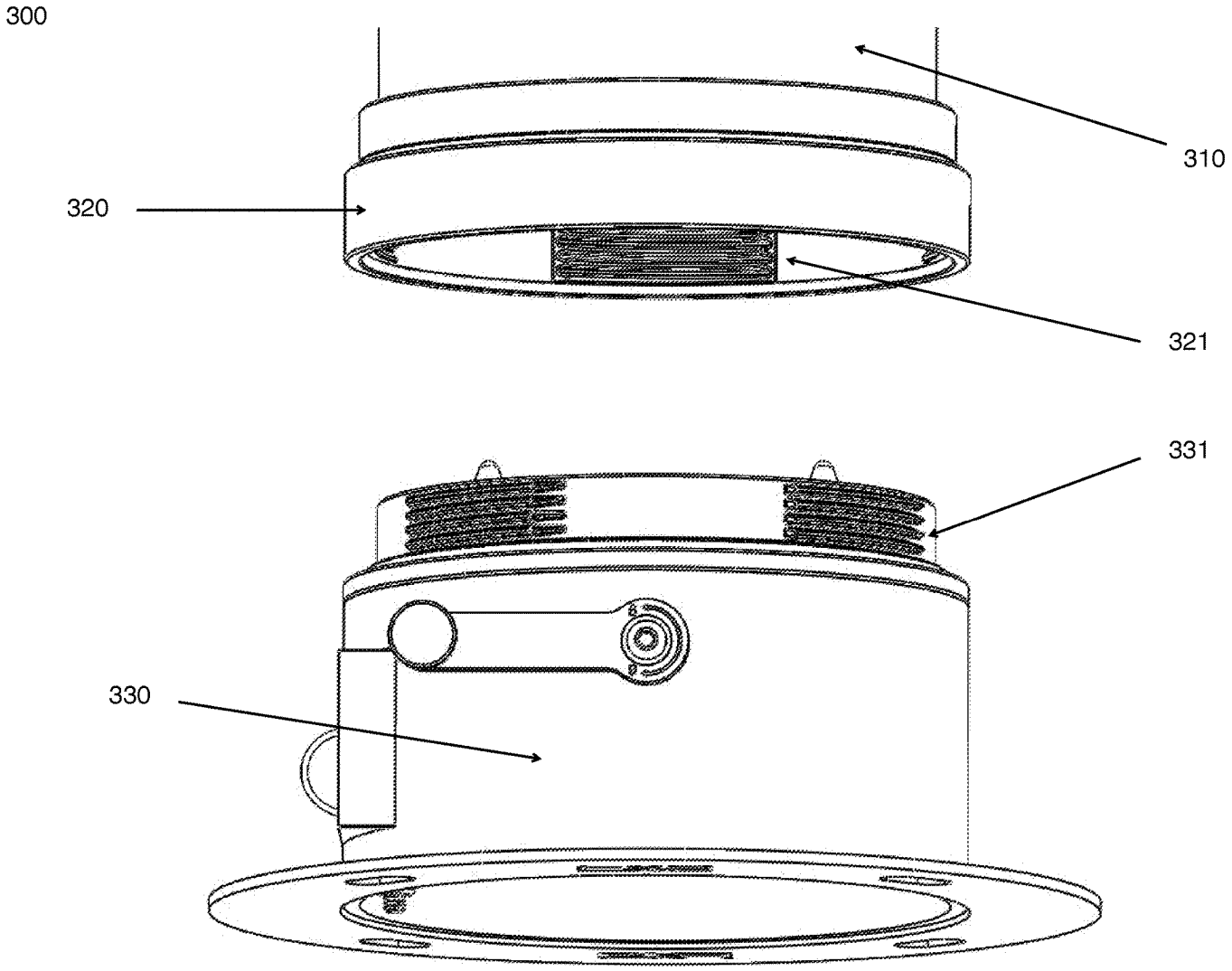
FIG. 3 illustrates an exemplary bottom assembly.

FIGS. 4C1-4C3 illustrate an exemplary embodiment of a conditioning piston assembly used in a cylindrical reservoir embodiment. Piston 430 may be employed in applications that require mixing or conditioning of the material within the reservoir for various operations. The piston 430 may be a cylindrical disk that is concave or hollowed out at the bottom 421. The outside of the disk has three grooves, 432*a*, 432*b*, and 432*c*, cut into the circumference of the disk. Sealing agents 433*a* and 433*b* are disposed within grooves 432*a* and 432*c* and around the circumference of the disk. In this exemplary embodiment, the sealing agents 433*a* and 433*b* are u-cup seals composed of a rubber compound. U-cup seal 433*a* is situated in groove 432*a* so that the protruding "U" lip is pointed towards the top assembly of the reservoir. U-cup seal 433*b* is situated in groove 432*c* so that the protruding "U" lip is point towards the bottom of the reservoir. Piston 430 may also include a torque suppression agent 434, which may be an inflatable diaphragm. An impeller 435 may be operatively connected to the material side, or top, of the piston 430. A motor 436 may be operatively connected to the impeller 435 and connected to the hollowed-out bottom 421 of the piston 430. An optional heating or cooling element 437 may operatively be connected to the material facing side of the piston 430. FIG. 4C4 illustrates piston 430 described above placed within a cylindrical reservoir body 110.

Figure 4D:
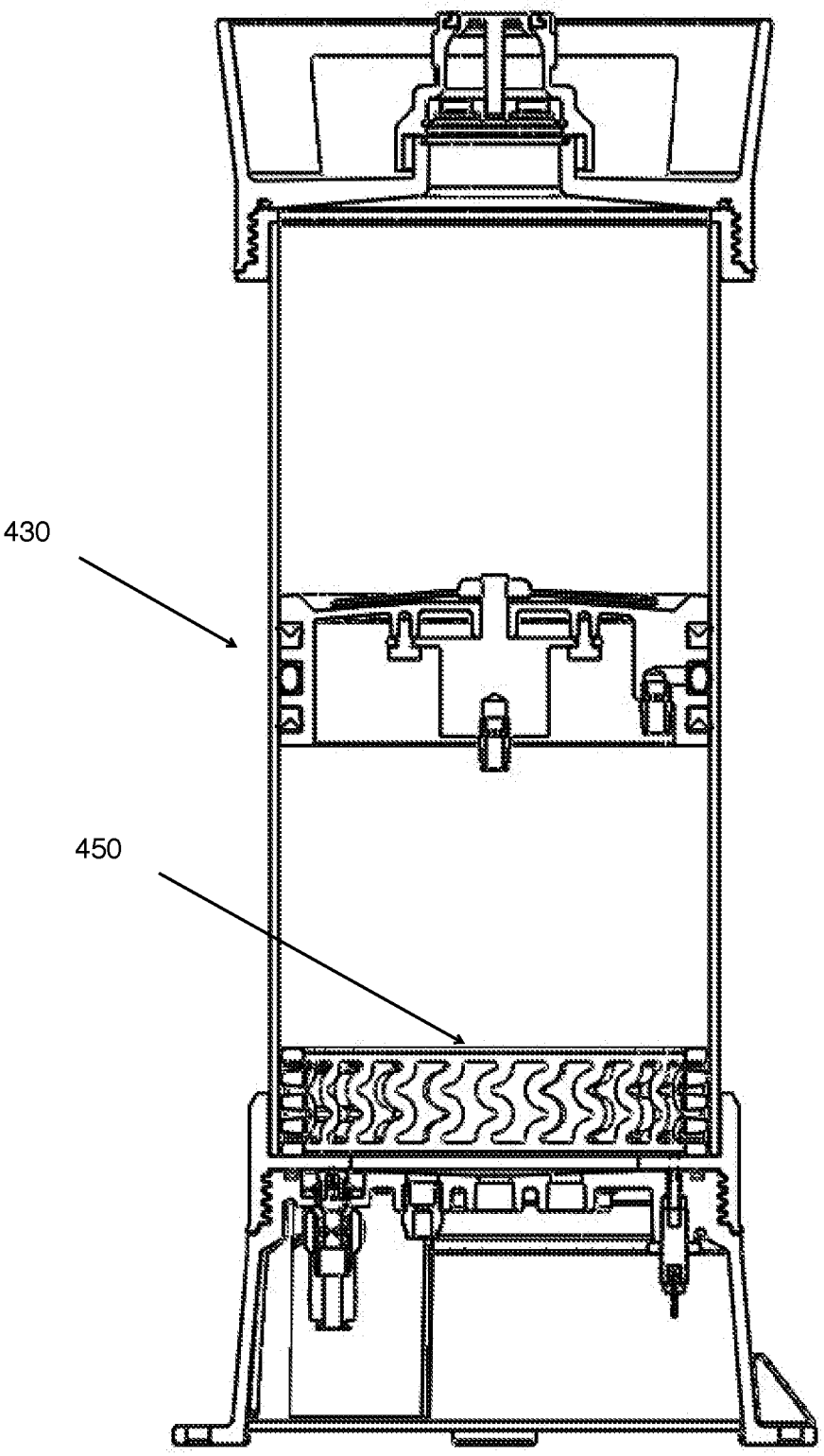
FIG. 4D illustrates an exemplary expansion agent in a reservoir utilizing a conditioning piston assembly.

FIG. 4D illustrates an example of the use of an expansion agent 450 in an assembled reservoir utilizing a conditioning piston assembly (as shown in FIG. 4C4). As shown, the expansion agent 450 may be placed near the bottom of the reservoir. However, any placement within the reservoir depending on the particular application is suitable.

Bottom Assembly

The bottom assembly is configured to operatively connect to the end of the reservoir body opposite the top assembly. FIG. 3 illustrates a close-up and expanded view of a generic bottom assembly 300 prior to connection with a charge base 330. The bottom assembly 300 may include a bottom adaptor ring 320 and an optional sealing component, which in some embodiments may be a charge base 330. The sealing component may comprise a charge base (described below)

or a threaded disk or similar component that would connect to the bottom adaptor and enclose the bottom of the reservoir body. In some embodiments, a sealing component may not be needed, leaving the bottom of the reservoir open. In some embodiments the bottom of the reservoir may be cast, molded, adhered to, or welded to the sidewalls of the reservoir. In some situations where the bottom of the reservoir is left open, the piston assembly may be the sealing component, for example, when reservoirs containing material are stored or shipped. Whether the bottom assembly seals the reservoir is dependent on the particular use of the reservoir.

In some embodiments that utilize a charge base (shown in FIG. 3), the bottom adaptor ring 320 may be configured to provide a connection point for the charge base 330 to securely attach to, and seal, the bottom of the reservoir body 310. The bottom adaptor ring 320 connection type may depend on a variety of factors, such as reservoir body composition, operating pressure requirements, and intended delivery type.

In some embodiments, the bottom adaptor ring 320 connection may be accomplished through locking threads 321 on the adaptor ring 320 and complimentary locking threads 331 on the charge base 330. The top of the charge base is placed into the adaptor ring 320 so that the locking threads 331 on the charge base fit into the spaces between the locking threads 321 on the adaptor ring 320. The reservoir body is then moved in the appropriate direction to lock the charge base in place. The bottom adaptor ring may include a sealing surface that seals against the top of the charge base so that the charge base becomes operatively connected to reservoir. In other embodiments, the bottom adaptor ring 320 connection may be configured as quick threads (described above).

Although the bottom adaptor ring 320 has been shown as being adhered to the outside with its threads providing a "female" connection, the adaptor ring 320 may be configured as a "male" connection for some embodiments. In these embodiments, the charge base threads would then be configured to provide the corresponding "female" connection.

In its embodiments, the connection type and seal type will depend on a variety of factors such as reservoir body composition, operating pressure requirements, and intended delivery type. Different embodiments may include cam locks, ball locks, bail and seal, and pin locks. However, any connection now known or known in the future that accomplishes a secure connection of the bottom assembly to the reservoir body may be used.

In its various embodiments, the bottom adaptor ring 320 may be secured to the reservoir body 310 in a variety of ways depending on the composition of the reservoir body and the adaptor ring. The connection and seal must be able to withstand the operating pressures of the reservoir while providing the needed structural integrity of the intended use. For example, in large reservoirs, operating pressures may reach and exceed 100 psi of operating pressure. In some embodiments, the bottom adaptor ring 320 may be aluminum and the reservoir body may be composed of a glass filament wound resin. The bottom adaptor ring 320 may be secured to the reservoir body via an adhesive system. In some embodiments, the adhesive system employs two-part methacrylate adhesives. An example of such a system is MP 55305 from Adhesive Systems, Inc. However, any adhesive system now known or known in the future that facilitates a secure connection of the bottom adaptor ring to the reservoir body may be used.

In other embodiments, the bottom adaptor ring may be molded into the reservoir body 310, essentially forming one piece. In such a case, the charge base may be connected to the reservoir body through a particular connection type. For example, locking threads may be molded into the reservoir body and the charge base is placed on or into the reservoir body and screwed until an air-tight seal is made. In some embodiments, the adaptor rings may be press fit.

Figure 5:
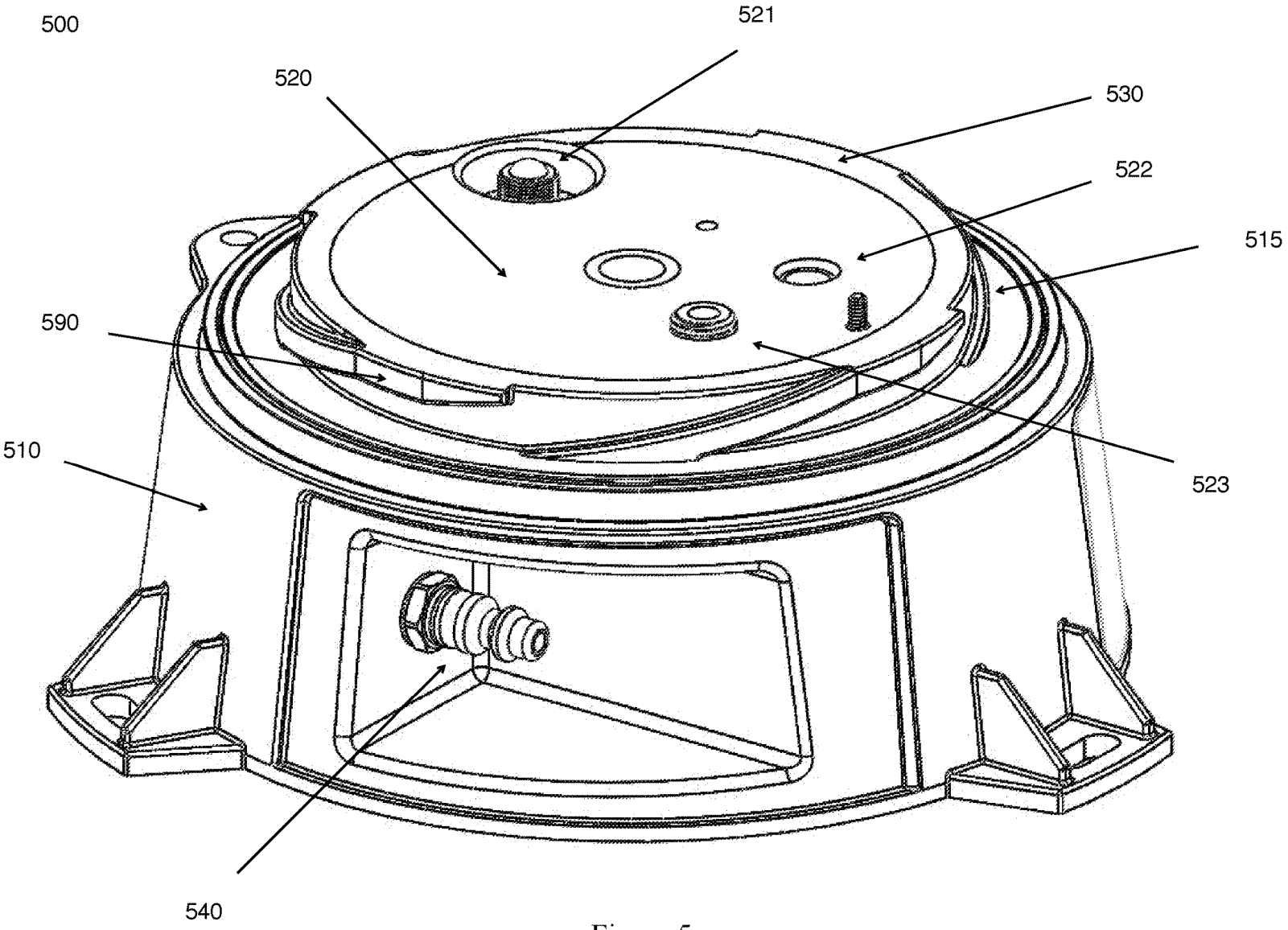
FIG. 5 illustrates an exemplary charge base.

Furthermore, a variety of methods may be used to provide a seal or enhance the sealing properties of the connection. In many of the invention's embodiments, flat faced seals, O-rings, quad seals, house seals, u-cup seals, or spring backed seals may be used. For example, the sealing surface (as shown in FIG. 5, ref. 520) may include an O-ring placed on or within the surface of the bottom adapter ring such that when the charge base 330 is screwed into place, the O-ring enhances the seal made between the bottom adaptor ring 320 and the charge base 330.

With reference to FIG. 1, the bottom assembly may include a charge base 500 having hardware and/or software configured to operatively connect to a reservoir's bottom adaptor ring creating a sealed pressurization area 112 so that a pressurization agent may be introduced into (i.e., pressurize) or withdrawn (i.e., vacuum) from the pressurization area 112. When the pressurization agent is introduced into area 112, a high-pressure force is created underneath the piston (and is then applied to the material if there is material in the material containment area), which "charges" the reservoir with an operating pressure. Such operating pressure will be maintained until the pressurization agent removed, additional pressurization agent is added, material is dispensed through the top assembly mechanism, or the reservoir is removed from the charge base. Further operations will be described below.

In general, the charge base may include a housing 510, a sealing surface 520, and a pressurization agent source 540. In some embodiments, the sealing surface may incorporate a sealing agent 530. The housing 510 may be configured to contain or support the hardware and/or software components of the charge base 500. The housing may be configured having a conical or round cross-section for support of the reservoir during operation. However, the top of the housing 515 will have the same cross section as the reservoir such that it may be connected to the bottom adaptor ring. For example, the top of the housing may be circular, while the cross section of the bottom of the housing may be square. The housing may be of any suitable material depending on the application. In some embodiments, the material may be aluminum. In other embodiments, the material may be polymer-based. However, any material that suitably facilitates a stable base and is able to contain the one or more of the components of the charge base may be used. Also, the housing may comprise one or more pieces connected together to form a suitable housing.

The charge base may include a sealing surface 520 that provides the "bottom" of the pressurization area. When the charge base becomes connected to the bottom of the reservoir, an air-tight seal is created so that pressurization operations may be conducted. In some embodiments, the sealing surface 520 may be part of the housing, in essence the "top" of the charge base. However, in other embodiments, the sealing surface may be a separate component operatively connected to the top of a charge base's housing.

The sealing surface 520 may contain a variety of pathways (referred to as "ports" in this description) enabling access to the pressurization area. These ports may be used for a variety of operations. For example, in its embodiments, the sealing surface may have a port through which the pressurization agent may be delivered/withdrawn, referred to as a pressurization port 521. In some embodiments, the sealing surface may incorporate a drain port 522 that enables fluid to be drained from the pressurization area. For example, while in operation, condensation may form on the inside of the reservoir body underneath the piston assembly or a seal might malfunction (leaking fluid onto the surface of the charge base). To insure proper operation and containment of any fluids, this fluid may be drained from the pressurization area. In some embodiments, a valve may be opened to allow condensation or leaked liquid collected within the port to drain out before removing the reservoir from the charge base. Optionally, some embodiments of the charge base and sealing surface may incorporate a pressure relief port 523, valve and/or system to relieve overpressure within the pressurization area.

Other embodiments of the charge base and sealing surface may include additional ports for electrical or mechanical means operatively connected to the pressurization chamber and/or attached to the piston assembly or the reservoir. For example, various sensors, RFID/NFC tags/readers, Bluetooth beacons (active or passive), WiFi modems, GPS receivers, cell modems, time of flight sensors, IR lasers or ultrasonic sensors, or batteries may be operatively connected within the pressurization area to monitor/control temperature, operating pressure, piston position, product conditioning, or product displacement.

In some embodiments, solenoids may be configured to control a manifold of pressurized air that pressurizes the reservoir. In other embodiments, pressurized air may be routed through a venturi to create a vacuum under the piston assembly. In some embodiments, the charge base status and/or functions may be monitored or controlled wirelessly through various communication protocols and structures suitable to the desired application, such as WiFi, Bluetooth, modems, cell phones, or cloud services.

In some embodiments, a microprocessor controller (battery or power supply) may be mounted within the charge base to monitor/control temperature, operating pressure, piston position, piston functionality (e.g., conditioning piston impeller), product displacement, or other reservoir functions.

Such operational information may be utilized to display or otherwise convey information, control other processes, initiate safety measures and the like. The additional ports also assist in automating reservoir operations.

To aid in sealing the pressurization area, the charge base may include a sealing agent 530. In some embodiments, the sealing agent 530 may be incorporated into the sealing surface 520. In other embodiments, the sealing agent 530 may be a separate piece that is connected to, or applied, to the sealing surface 520 or housing 510. The sealing agent may be a chemical and/or a physical-based agent. In some embodiments, the sealing agent may be a physical agent, for example, a gasket or O-ring. In other embodiments, the sealing agent may be a chemical compound that is applied to the sealing surface. In other embodiments, the sealing agent may be cast-in-place (or otherwise known as a form-in-place) gasket. However, any sealing agent now known or known in the future that accomplishes, or aids in creating, a seal between the bottom adaptor and the sealing surface is may be used.

The charge base 500 may include a threading system 590 which operatively connects to the bottom adaptor ring to ensure a sealed pressurization area. In some embodiments, a reservoir may be placed on the top of the charge base and then move to create the desired seal. In the depicted exemplary charge base 500, the threading system is configured as quick threads 590, though any suitable threading system may be used.

The charge base 500 may include hardware and/or software configured to receive pressure from a pressurization source. In some embodiments, the housing may contain an adaptor 540 and/or tubing that is connected from the pressurization port to a source outside of the charge base. For example, in embodiments where the pressurization agent is air, the pressurization port may be operatively connected through tubing to a high-pressure air source through adaptor 540, such as an air compressor. The tubing may be of any material suitable for the particular application. In some embodiments, tubing may be metal or polymer-based. Pressurization operations may be accomplished manually or using automation.

In other embodiments, the pressurization source 540 may be a capsule operatively connected to pressurization port 521. For example, a capsule containing high pressure carbon dioxide, or some other similar pressurization substance, may be placed underneath or within the housing of the charge base that when activated will pressurize the pressurization area.

The charge base may also include one or more pressure regulators. In some embodiments, the input pressure may need to be reduced to a desired value ("operating pressure") before introduction in to the pressurization area. In other embodiments, a pressure regulator may monitor and/or regulate internal pressure of the pressurization area. Pressure regulators are well known and will not be explained in detail here. Any type of pressure regulator suitable for the specific application may be used.

Figure 6B:
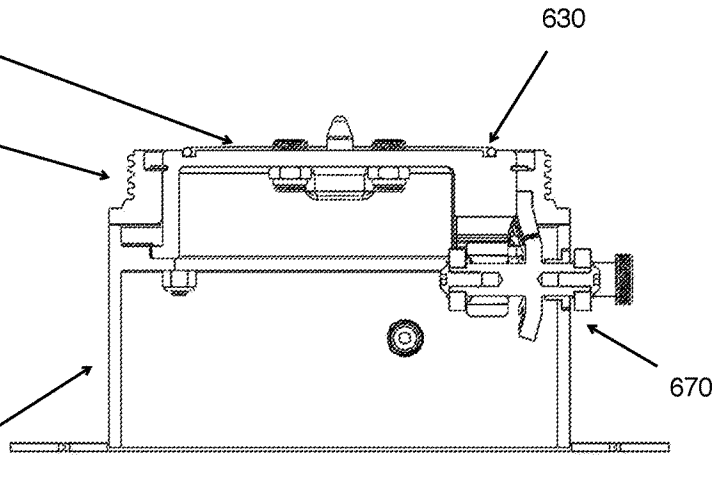
FIG. 6B illustrates a side view of an exemplary embodiment of a charge base.
Figure 6A:
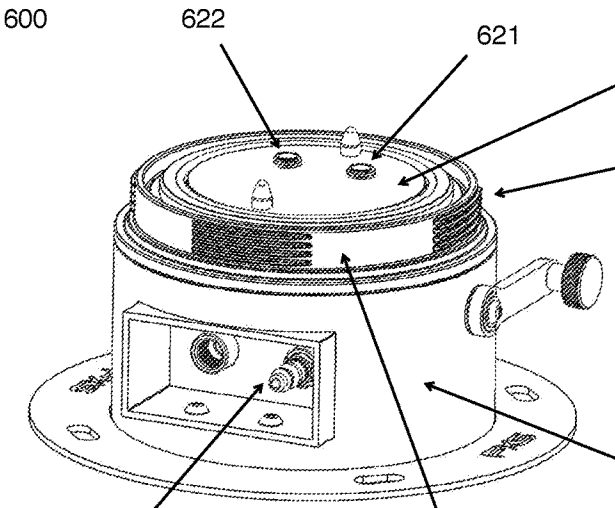
FIG. 6A illustrates an isometric view of an exemplary embodiment of a charge base.
Figure 6C:
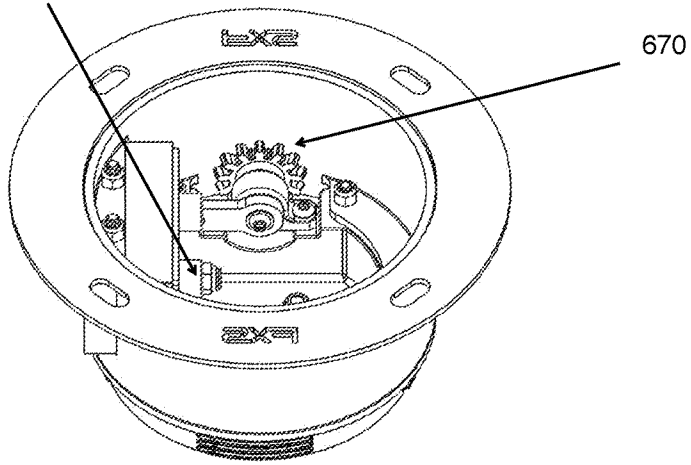
FIG. 6C illustrates a bottom view of an exemplary embodiment of a charge base.

Other safety measures may be employed by or through the charge base. In some embodiments, a mechanical lock may be configured to engage a flange attached to the bottom adaptor ring to prevent separational rotation while under operational pressure. In other embodiments, a mechanical lock may prevent removal of the charge based if the reservoir is under pressure FIGS. 6A-6C illustrate another exemplary embodiment of a charge base 600 for use with a cylindrical reservoir. Charge base 600 has a housing 610, a sealing surface 620, and an adaptor 650 to connect to an outside pressurization source. The sealing surface 620 is configured to have a pressurization port 621 and a drain port 622. The pressurization port 621 is connected to the adaptor 650 creating a pathway for pressurization or vacuum operations. The drain port 622 may be connected directly or by tubing to a collection point (not shown) for any material leakage that may occur. The sealing surface 620 may have a sealing agent 630, in this embodiment, an O-ring, disposed within a circular groove within the sealing surface 620. As depicted in FIG. 3, a reservoir with complimentary locking threads is lowered onto the top of the charge base so that the bottom assembly locking threads fit into the spaces 665 between the locking threads 660 of the charge base 600. To create a seal before reservoir operations, a handle connected to a rack and pinion system 670 is turned that spins the charge base locking threads 660 and engages the locking threads of the bottom assembly.

Reservoir Operations

Movement of the piston assembly may be accomplished in multiple ways. For example, a pressurization agent is introduced into pressurization area 412 or a vacuum is applied to area 412, which would move the piston assembly 400 up or down, respectively; (2) introducing or withdrawing material from material containment area 411, which would move the piston assembly 400 down or up, respectively; or (3) a vacuum may be applied to the material containment area 411 through the top assembly 200. Other ways to accomplish movement of the piston depend on the desired use of the reservoir.

In general, a reservoir filling operation may include introducing material through the top assembly of the reservoir into the body on top of the piston assembly. Fluid may be introduced into the reservoir in a number of ways including (i) through an open-ended reservoir (i.e., the top assembly has not been attached to the top adaptor ring); (ii) through the top cap adaptor fitting (i.e., the adaptor coupling has not been attached to the top cap); or (iii) through the adaptor coupling (i.e., the reservoir is sealed at the top). The particular filling method depends on the specific application.

In some embodiments where a charge base-less reservoir is assembled and sealed at the top, the reservoir may be connected to a pressurized fluid source through the reservoir's adaptor coupling. With the piston assembly at its topmost position, the pressurization area (FIG. 1, ref. 112) is open to the atmosphere. Such configuration enables the pressurized fluid to flow into the material containment area (FIG. 1, ref. 111). When the piston assembly is at its lowermost position (or some other pre-determined position), a sensor may be configured to detect back pressure and stop the filling process.

In some filling method embodiments, a pressurization agent may be introduced through the charge base into the sealed pressurization area 112 below the piston assembly to a desired operating pressure. The starting position of the piston assembly may be at the top of the body; however, any starting position is suitable consistent with the intended end use. In some embodiments, the starting position of the piston may be determined by the start pressure of the gas pressurization underneath the piston.

Material is introduced into the material containment area 111 above the piston assembly, which in turn forces the piston downward against the gas. This process increases the pressure of the area below the piston assembly, if the pressurization area is sealed, for example, by the charge base. In some embodiments, a valve may be incorporated within the charge base to enable gas from the pressurization area to escape to the atmosphere. Once the fill level is obtained, the top assembly is closed.

In some embodiments, once the material containment area is filled to the desired level and the top assembly is closed, the reservoir may be pre-charged with a desired level of pressure. In some embodiments, this pre-charging may be accomplished with a pressurization agent. In some other embodiments, the desired level of pressure is accomplished by an expansion agent, e.g., a compression donut. In yet other embodiments, both a pressurization agent and an expansion agent may be used to accomplish the desired level of pressure. After pressurization, the reservoir and its contents may be stored and transported. No dead head space (or in some embodiments, minimal dead head space) is required in the reservoir and the contents are under pressure while stored. However, the contents are still allowed to expand and contract during the thermal cycle due to the ability of the piston assembly to "float."

In general, a dispensing operation may include opening a pathway from the material containment area through the top assembly of the reservoir. The pressure differential between the top and bottom areas within the body of the reservoir forces the piston assembly to move upwards. Once the top assembly pathway is opened, the gas under the bottom of the piston forces the piston to move further towards the top assembly dispensing the product through the pathway. In some embodiments employing this type of pressurization agent, one way to control the flow of the material through the top assembly is by an apparatus that is connected to and/or manipulates the top assembly or pathway. For example, a grease gun, a paint sprayer or a flow control meter may contain control mechanisms that monitor and/or regulate flow from the reservoir through the closed system of the gun to the final application. In other embodiments, a pressure regulator may be operatively connected within the bottom assembly or charge base to regulate the movement of the piston.

In another exemplary embodiment of a dispensing operation involving the reservoir without a pressurization agent, there is initially no pressure under the piston. In some embodiments, to dispense the material using pressure the reservoir may be connected to a charge base. The charge base provides the pressurization agent through the bottom assembly and into the area below the piston. In some other embodiments, a vacuum may be applied to the top assembly (e.g., though the top adaptor coupling) to withdraw the material from the material containment area. This results in "pulling" the piston assembly up towards the top assembly.

In embodiments with an assembled reservoir and operatively connected charge base, the charge base may introduce a vacuum to the pressurization area 112. The vacuum results in the piston assembly being drawn toward the bottom of the reservoir. Such configuration may be used to draw fluid into the storage reservoir, for example, from another container. The container may be pressurized or non-pressurized. One benefit of the vacuum process is transferring material between two reservoirs or a reservoir and another type of container so that the material is not exposed to atmospheric air and potential contamination. Another benefit is that used material may be reclaimed from end use equipment.

Although the above description may contain specific details, they should not be construed as limiting the claims in any way. The descriptions and embodiments are not intended to be exhaustive or to limit the invention to the precise forms disclosed. Accordingly, the appended claims and their legal equivalents should only define the invention, rather than any specific examples given.

What is claimed is:

1. A material storage and dispensing system comprising:

a hollow reservoir body configured as a tube with a first open end and a second open end;

a top cap adaptor ring adhered to the first end on the outside of the hollow reservoir body;

a top assembly operatively connected to the first open end of the reservoir body; the top assembly comprising:

a top cap configured to connect to the top cap adaptor ring on the hollow reservoir body;

an adaptor fitting operatively connected within the top cap;

an adaptor coupling with a first end configured to operatively connect to the adaptor fitting and a second end, and configured to be able to receive both (a) another reservoir of the material storage and dispending system, or (b) an end use apparatus, wherein the top assembly and the adaptor coupling connection provides a seal at the first end of the hollow reservoir body;

a bottom adaptor ring operatively connected to the second open end of the reservoir body; and a moveable piston assembly disposed within the hollow reservoir body, wherein the adaptor coupling and the piston assembly create a first sealed area within the reservoir body.

2. The system of claim 1, wherein the reservoir body is composed of glass filament wound epoxy.

3. The system of claim 1, the connection type at the top cap and top cap adaptor ring is selected from the group of locking threads, press fit, quick threads, cam locks, ball locks, bail and seal, and pin locks.

4. The system of claim 1, wherein the adaptor fitting is molded into the top cap forming one piece.

5. The system of claim 1, wherein the adaptor coupling comprises a moveable poppet.

6. The system of claim 1, wherein the adaptor coupling includes a dry break fitting.

7. The system of claim 1, wherein the top assembly comprises one or more locking mechanisms.

8. The system of claim 1, wherein the piston assembly comprises a piston and a sealing agent.

9. The system of claim 8, wherein the sealing agent is selected from the group of gasket, O-ring, U-cup, quad ring, and inflatable diaphragm.

10. The system of claim 8, wherein the piston has a convex sloped top.

11. The system of claim 8, wherein the piston has three grooves cut into the piston's outside circumference.

12. The system of claim 8, wherein the piston is a conditioning piston configured to mix material within the first sealed area.

13. The system of claim 1, further comprising a charge base operatively connected to the bottom adaptor ring, the charge base comprising a housing, a sealing surface, and an adaptor that connects to a pressurization source.

14. The system of claim 13, wherein the charge base is configured to connect to the bottom adaptor ring and wherein the connection type is selected from the group of locking threads, press fit, quick threads, cam locks, ball locks, bail and seal, and pin locks.

15. The system of claim 13, wherein the charge base and the piston assembly create a second sealed area within the reservoir body.

16. The system of claim 13, wherein the charge base is configured to introduce a pressurization agent from the second sealed area.

17. The system of claim 13, wherein the charge base is configured with a drain port.

* * * * *